US007793368B2

(12) United States Patent
Burrell, IV

(10) Patent No.: US 7,793,368 B2
(45) Date of Patent: Sep. 14, 2010

(54) MESH CRIB BUMPER AND ENCLOSURE

(76) Inventor: James W. Burrell, IV, P.O. Box 3822, Union, NJ (US) 07083-1891

( * ) Notice: Subject to any disclaimer, the term of this patent is extended or adjusted under 35 U.S.C. 154(b) by 36 days.

(21) Appl. No.: 12/141,801

(22) Filed: Jun. 18, 2008

(65) Prior Publication Data

US 2009/0313755 A1 Dec. 24, 2009

(51) Int. Cl.
*A47D 7/00* (2006.01)
*A47D 15/00* (2006.01)

(52) U.S. Cl. ..... 5/424; 5/93.1; 5/97; 5/946

(58) Field of Classification Search ..... 5/97, 5/427, 512, 946, 93.1, 424; 256/25
See application file for complete search history.

(56) References Cited

U.S. PATENT DOCUMENTS

| | | | | |
|---|---|---|---|---|
| 1,264,734 | A | 4/1918 | Williams | |
| 1,432,190 | A | 10/1922 | Krueger | |
| 2,357,218 | A | 8/1944 | Merrett | |
| 2,566,790 | A * | 9/1951 | Bloomfield | 5/93.1 |
| 2,635,257 | A | 4/1953 | Knoll | |
| 2,927,331 | A | 3/1960 | Ruiz | |
| 3,018,492 | A | 1/1962 | Rosen | |
| 3,619,824 | A | 11/1971 | Doyle | |
| 3,877,090 | A | 4/1975 | Schultz | |
| 3,879,773 | A | 4/1975 | Spencer | |
| 3,979,783 | A | 9/1976 | Spencer | |
| 4,359,792 | A | 11/1982 | Dale | |
| 4,670,923 | A | 6/1987 | Gabriel et al. | |
| 4,862,534 | A | 9/1989 | Gomez-Marcial | |
| 4,890,346 | A | 1/1990 | Rist | |
| 5,161,269 | A | 11/1992 | McLean et al. | |
| 5,241,718 | A | 9/1993 | Pope | |
| 5,410,765 | A | 5/1995 | Dicken | |
| 5,421,046 | A | 6/1995 | Vande Streek | |
| 5,437,071 | A | 8/1995 | Feigenbaum | |
| D365,957 | S | 1/1996 | Ferrari | |
| 5,542,135 | A | 8/1996 | Ozrovitz et al. | |
| 5,555,577 | A | 9/1996 | Volpe | |
| 5,561,876 | A | 10/1996 | Petruzella | |
| 5,577,276 | A | 11/1996 | Nicholson et al. | |
| 5,699,571 | A | 12/1997 | Yowell | |
| 5,706,534 | A | 1/1998 | Sherman | |
| 5,806,112 | A | 9/1998 | Harms | |
| 5,881,408 | A | 3/1999 | Bashista et al. | |

(Continued)

*Primary Examiner*—Michael Trettel
(74) *Attorney, Agent, or Firm*—Ezra Sutton, P.A.

(57) ABSTRACT

A mesh crib bumper enclosure having four connected vertical mesh fabric panel sections installed in a crib by suspending it from top and bottom corners and securing it to four corner posts. The enclosure panels are stretched tightly between the corner posts using a locking fastener. The mesh fabric panels allow air to circulate through the crib to prevent exhaled carbon dioxide from building up. The enclosure corners receive vertical support members for vertical structural integrity while top and bottom edges can receive horizontal support members for horizontal structural integrity. The enclosure bottom corners use tie string fasteners to secure the enclosure to bottom crib rails to keep the bottom edges in contact the mattress. Other embodiments use a mesh panel base attached to the enclosure bottom and/or a mesh panel sealable top for sealing off the top to prevent insects and animals from entering the mesh crib bumper enclosure.

10 Claims, 18 Drawing Sheets

U.S. PATENT DOCUMENTS

| | | | |
|---|---|---|---|
| 5,926,873 | A | 7/1999 | Fountain |
| 5,933,885 | A | 8/1999 | Glassford |
| 5,937,458 | A | 8/1999 | DeRosa |
| 5,960,493 | A | 10/1999 | Rhey et al. |
| 6,055,690 | A | 5/2000 | Koenig |
| 6,131,216 | A | 10/2000 | Pine |
| 6,170,101 | B1 | 1/2001 | McCloud |
| 6,178,573 | B1 | 1/2001 | Wagner et al. |
| D444,329 | S | 7/2001 | Newman |
| 6,256,813 | B1 | 7/2001 | Aaron |
| 6,263,894 | B1 | 7/2001 | LaMantia |
| 6,421,857 | B2 | 7/2002 | Whatman et al. |
| 6,438,775 | B1 | 8/2002 | Koenig |
| 6,550,083 | B1 | 4/2003 | LaMantia |
| 6,564,403 | B1 | 5/2003 | Titus |
| 6,611,976 | B2 | 9/2003 | Guillot |
| 6,684,437 | B2 | 2/2004 | Koenig |
| 6,772,457 | B1 | 8/2004 | Alaback |
| 6,859,958 | B2 | 3/2005 | LaMantia |
| 6,957,464 | B1 | 10/2005 | Coauette |
| 7,003,823 | B1 | 2/2006 | Reed et al. |
| 7,055,192 | B2 | 6/2006 | Waters et al. |
| 7,213,282 | B1 | 5/2007 | Wojtowicz |

* cited by examiner

MESH CRIB BUMPER AND ENCLOSURE

FIELD OF THE INVENTION

The present invention relates to a breathable mesh panel enclosure, used as a crib bumper which allows air to circulate through the crib compartment and prevents a baby from hitting their head or appendages on the vertical balusters on a crib or from getting their head or appendages stuck between the crib's balusters. The breathable mesh panel enclosure helps to prevent Sudden Infant Death Syndrome (SIDS) by preventing the re-breathing of exhaled carbon dioxide and in other embodiments it is used as an insect and animal barrier.

BACKGROUND OF THE INVENTION

Since the introduction of crib, many different types of prior art cribs have been developed in the past to contain and protect infants, babies and small children. Most of these devices are produced using balusters held in place using top and bottom horizontal rails on either side of the crib or on all four sides of the crib, allowing airflow through the crib. Usually one side of the crib is adjustable, allowing easy access into the crib compartment. Another crib innovation allows the mattress to be raised or lowered inside of the crib compartment using an adjustable mattress platform. Since the introduction of the crib, infants, babies and small children have become lodged between the balusters, resulting in injury or death. Cribs are now manufactured with smaller spacing between the balusters. The padded crib bumper was invented to prevent infants, babies and small children from becoming lodged between the balusters or from becoming injured when impacting the balusters. The down side to the padded crib bumper, is that it prevents the circulation of air within the crib compartment and allows a baby to re-breath exhaled carbon dioxide which may cause Sudden Infant Death Syndrome (SIDS).

The following prior art references, which the inventor is aware of, are distinctly different than the present invention described in this patent application.

Many types of cribs and crib innovations have been patented in the past. Some prior art crib designs using balusters in the wall construction include; U.S. Pat. No. 1,432,190 issued on Oct. 17, 1922 to Krueger, titled "CRIB", U.S. Pat. No. 2,357,218 issued on Aug. 29, 1944 to Merrett, titled "CRIB CONSTRUCTION", U.S. Pat. No. 2,635,257 issued on Apr. 21, 1953 to Kroll, titled "BABY CRIB", U.S. Pat. No. 3,879,773 issued on Apr. 29, 1975 to Spencer, titled "CRIB", U.S. Pat. No. 3,979,783 issued on Sep. 14, 1976 to Spencer, titled "CRIB OR YOUTHBED" and U.S. Pat. No. 6,611,976 issued on Sep. 2, 2003 to Guillot, titled "CHILD'S CRIB".

There have also been attempts to produce cribs without balusters to keep a baby from hitting their head and appendages on the crib's balusters and for keeping the head and appendages from getting stuck between the balusters. U.S. Pat. No. 4,359,792 issued on Nov. 23, 1982 to Dale, titled "CRIB" describes a crib replacing the crib's balusters with mesh panels on the left and right wall sections and on the head and foot wall sections. U.S. Pat. No. 6,256,813 issued on Jul. 10, 2001 to Aaron, titled "CRIB" describes a crib using a mesh sleeping surface and replaces the crib's balusters with mesh panels on the left and right wall sections and on the head and foot wall sections. These improvements to the crib's design have merit, but a majority of the cribs presently used and manufactured throughout the world today still use the standard vertical spindle or rail design.

Many types of crib bumpers for preventing a baby from hitting their head or appendages on the balusters on a crib and for keeping the head and appendages from getting stuck between the crib's spaced balusters have been patented in the past. Although there have been a multitude of patents issued on the crib bumper throughout the years, the basic design is still the same. Some of the more important prior art crib bumper patents and innovations are briefly described hereafter.

U.S. Pat. No. 3,018,492 issued on Jan. 30, 1962 to Rosen, titled "PROTECTIVE BUMPER DEVICE" describes an inflatable crib bumper manufactured out of a resilient, flexible, air tight material of rubber, latex or plastic. The inflatable crib bumper is releasably secured on all four corners of the crib and at the top and bottom sections, on both ends of the four wall sections, to the balusters. Unlike the present invention, the inflatable crib bumper does not allow air to circulate through it, the inflatable crib bumper does not protect the baby from impacting the balusters above the bumper, the baby can become lodged between the bumper and the mattress or between the bumper and the balusters and the inflatable crib bumper can be punctured by a sharp object, making the bumper inoperable from protecting a baby from impacting the balusters through the deflated bumper.

U.S. Pat. No. 3,619,824 issued on Nov. 16, 1971 to Doyle, titled "CRIB BUMPER" describes a crib bumper manufactured out of a cushioning material of flexible resilient compressible foam rubber or down. The covering of the bumper is preferably an un-breathable waterproof fabric or plastic. A waterproof fabric or plastic extension is on the bottom of the bumper, for securing the bumper underneath or against the mattress. Unlike the present invention, the crib bumper does not allow air to circulate through it, the crib bumper does not protect the baby from impacting the balusters above the bumper and the baby can still become lodged between the bumper and the mattress or between the bumper and the balusters.

U.S. Pat. No. 3,877,090 issued on Apr. 15, 1975 to Schultz, titled "CRIB BUMPER AND MATTRESS" describes a crib bumper manufactured out of a cushioning material of flexible resilient compressible foam rubber or down and attached to a crib's balusters using a tying or snapping tab method. The crib bumper also has a means of attaching elastic tabs with male and female interlocking snaps from the bottom of the bumper to the mattress support or to a mattress manufactured with bumper attaching mating means on the sides or bottom of the mattress. The covering of the bumper is preferably an un-breathable waterproof fabric or plastic. Unlike the present invention, the crib bumper does not allow air to circulate through it, the crib bumper does not protect the baby from impacting the balusters above the bumper and the baby can still become lodged between the bumper and the mattress or between the bumper and the balusters.

U.S. Pat. No. 4,670,923 issued on Jun. 9, 1987 to Gabriel et al., titled "TRANSPARENT CRIB BUMPER PADS" describes an inflatable crib bumper manufactured out of a transparent waterproof plastic material. The inflatable crib bumper is releasably secured on all four corners of the crib and at the top and bottom sections, on both ends of the four wall sections, to the balusters. All four bumper sections are connected for inflation. An alternative embodiment of the invention connects all four bumper sections to an inflatable mattress bottom section. Unlike the present invention, the inflatable crib bumper does not allow air to circulate through it, the baby can become lodged between the bumper and the mattress or between the bumper and the balusters and the inflatable crib bumper can be punctured by a sharp object, making the bumper or bumper and mattress inoperable from protecting a baby from impacting the balusters through the deflated bumper.

U.S. Pat. No. 4,890,346 issued on Jan. 2, 1990 to Rist, titled "INFANT CRIB ENCLOSURE" describes a fabric crib bumper filled with a resilient compressible material and attached to a crib's balusters using tie strings and each bumper panel is attached to a mattress sheet using hook and loop Velcro™ fasteners. The crib bumper also has a means of subdividing the compartment into two separate compartments for a newborn or for twins using a fifth bumper panel. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 5,010,611 issued on Sep. 7, 1983 to Pope, titled "BUMPER PAD FOR INFANT CRIB" describes a soft fabric material crib bumper filled with padding attached to a crib's balusters and four corner posts using flaps secured closed using Velcro™ or snaps. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 5,161,269 issued on Nov. 10, 1992 to McLean et al., titled "CRIB COVER" describes a form fitted soft, flexible material crib bumper attached to a crib's balusters using tie strings or straps. The form fitted crib bumper fits between the mattress and the balusters and has a notch for receiving the mattress. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 5,241,718 issued on Sep. 7, 1993 to Pope, titled "BUMPER PAD FOR INFANT CRIB" describes a hollow one piece crib bumper manufactured out of a soft fabric for receiving padding at an open end which is releasably secured closed forming a closed loop. The bumper is attached to a crib's balusters and four corner posts using flaps on the outside surface with snaps or a hook and loop securing method. Unlike the present invention, the crib bumper does not allow air to circulate through it, the crib bumper does not protect the baby from impacting the balusters above the bumper and the baby can still become lodged between the bumper and the mattress or between the bumper and the balusters.

U.S. Pat. No. 5,410,765 issued on May 2, 1995 to Dicken, titled "CRIB BUMPER PAD" describes a hollow crib bumper cover made out of a washable soft cloth material for receiving cushioning padding material and a stiffener at an open end which is secured closed using Velcro™ or a zipper, etc. The bumper is attached to a crib's balusters and four corner posts using tie strings on the bumper's outside surface. The lower portion of the bumper fits tightly between the bottom section of a crib's balusters and the side of the mattress. The bumper pad con be used on the left and right sides of the crib or it can surround all four sides of a crib. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 5,421,046 issued on Jan. 6, 1995 to Vande Streek, titled "BED BUMPER PAD" describes individual inflatable crib bumper panels manufactured out of a flexible and transparent material. Each inflatable crib bumper panel has an independent means of inflation. Each inflatable crib bumper is secured using one horizontal centrally located long strap with Velcro™ securing ends attached to the outside of the bumper for wrapping around the crib posts and the balusters. Unlike the present invention, the inflatable crib bumper does not allow air to circulate through it, the baby can become lodged between the bumper and the mattress or between the bumper and the balusters and the inflatable crib bumper can be punctured by a sharp object, making the bumper or bumper and mattress inoperable from protecting a baby from impacting the balusters through the deflated bumper.

U.S. Pat. No. 5,437,071 issued on Aug. 1, 1995 to Feigenbaum, titled "INDIVIDUAL PROTECTIVE PADS FOR CRIB BALUSTERS" describes a baluster crib pad secured onto the crib baluster using a Velcro™ securing means. Unlike the present invention, the baluster crib pad does not allow total air circulation, the crib bumper does not protect the baby from impacting the four corner posts and the baby can still become lodged between the balusters.

U.S. Pat. No. D365,957 issued on Jan. 9, 1996 to Ferrari, titled "CRIB BUMPER PAD" shows a fabric side rail barrier secured over the top of a crib's horizontal rail using snaps and tie strings. The barrier fits between the mattress and the balusters. Unlike the present invention, the crib barrier does not allow air to circulate through it unless it is manufactured out of a mesh fabric and the crib barrier does not protect the baby from impacting the balusters.

U.S. Pat. No. 5,577,276 issued on Nov. 26, 1996 to Nicholson et al., titled "CRIB BUMPER PAD WITH RELEASABLE SHEET" describes a one piece box shaped crib bumper with four side walls and a bottom section made out of a padded material using a hook Velcro™ securing means on the inside upper walls for receiving a custom fit open corner box sheet using a loop Velcro™ securing means on the outside upper surface of the conformable box sheet. The bumper is attached to a crib's balusters using centrally located tie strings on the one piece box shaped crib bumper's outside surface. Unlike the present invention, the one piece box shaped crib bumper does not allow air to circulate through it, the crib bumper does not protect the baby from impacting the balusters above the bumper and the baby can still become lodged between the top of the bumper and the balusters.

U.S. Pat. No. 5,561,876 issued on Oct. 8, 1996 to Petruzella, titled "INFANT MATTRESS" describes a mattress like structure used as a partial crib bumper. The rectangular shaped mattress uses four straight sections interconnected to four corner sections inserted into a mesh sleeve with a zippered closure means. Unlike the present invention, the crib bumper does not protect the baby from impacting the balusters above the top of the mattress and the baby can still become lodged between the top of the mattress and the balusters.

U.S. Pat. No. 5,706,534 issued on Jan. 13, 1998 to Sherman, titled "PROTECTIVE BUMPER PAD" describes a one piece flexible fabric material crib bumper filled with flexible foam or foam rubber, which is secured to the crib's balusters using tie strings, located on the bumper's outside fabric surface. The lower section of the flexible fabric crib bumper is positioned underneath the mattress. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 5,806,112 issued on Sep. 15, 1998 to Harms, titled "BABY CRIB LINER" describes a one piece crib bumper attached to a flexible base member, located beneath a mattress, which is secured to the crib's balusters using tie strings, located on the bumper's outside fabric surface. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 5,881,408 issued on Mar. 16, 1999 to Bashista, et al., titled "MESH CRIB LINER" describes a crib liner made of netting placed on the inside of the crib's balusters extending beneath the mattress and extending over the top of the top horizontal rail. The sides of the crib liner are secured to the top of crib's side balusters using Velcro™ fasteners. The head and foot section of the crib liner are attached to the top of the crib using rods inside sleeves, with four ties for attaching the rods to the four corners of the crib. The lower portion of the crib liner uses four ties to secure the crib liner to the crib. Unlike the present invention, the crib bumper does not protect the baby from impacting the balusters.

U.S. Pat. No. 5,926,873 issued on Jul. 27, 1999 to Fountain, titled "CRIB RAILING GUARD" describes a resilient cushion or inflatable one piece crib bumper "crib railing guard", which is secured to the crib's balusters using fasteners, located on the bumper's outside surface. The lower section of the crib bumper is placed between the crib's balusters and the mattress or continues underneath the mattress. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 5,933,885 issued on Aug. 10, 1999 to Glassford, titled "BABY CRIB BUMPER" describes a one piece flexible fabric material crib bumper filled with flexible foam or foam rubber, which is secured to the crib's balusters using tie strings or Velcro™ fasteners, located on the bumper's outside fabric surface. The removable lower section of the flexible fabric crib bumper is a mesh material and is positioned underneath the mattress. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 5,937,458 issued on Aug. 17, 1999 to DeRosa, titled "CRIB BUMPER SAFETY SYSTEM" describes a one piece crib bumper which is secured to the crib's balusters using tie strings or Velcro™ fasteners, located on the bumper's outside surface. The bottom panel of the crib bumper fits between the mattress and the balusters. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 5,960,493 issued on Oct. 5, 1999 to Rhey et al., titled "SAFETY BUMPER PAD" describes a one piece crib bumper with a mattress retaining sheet which is secured to the crib's balusters using locking straps, located on the bumper's outside surface. The mattress retaining sheet of the crib bumper fits between the mattress and the balusters and under the mattress. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 6,055,690 issued on May 2, 2000 to Koenig, titled "SLEEPING PAD, BEDDINGS AND BUMPERS TO IMPROVE RESPIRATORY EFFICIENCY AND ENVIRONMENTAL TEMPERATURE OF AN INFANT AND REDUCE THE RISKS OF SUDDEN INFANT DEATH SYNDROME (SIDS) AND ASPHYXIATION" describes individual baluster pads, ventilated bedding and a rectangular ventilated crib bumper which is secured to the crib's corner posts using Velcro™. Unlike the present invention, the patent does not protect the baby from impacting the balusters above the bumper and the baby can still become lodged between the top of the bumper and the balusters.

U.S. Pat. No. 6,131,216 issued on Oct. 17, 2000 to Pine, titled "METHOD AND APPARATUS FOR REMOVING HEAVY GASES FROM INFANT CRIBS" describes multiple partially ventilated crib bumpers using gravity or a fan to remove heavy gases from the bottom of a crib's bumper compartment. Unlike the present invention, the crib bumper does not allow air to circulate through the entire bumper and only through a small portion of it, the crib bumper does not protect the baby from impacting the balusters above the bumper and the baby can still become lodged between the top of the bumper and the balusters.

U.S. Pat. No. 6,170,101 issued on Jan. 9, 2001 to McCloud, titled "SEE THROUGH PROTECTIVE CRIB COVER CONSTRUCTION" describes a crib bumper with netting recessed in geometric viewing portals. The crib bumper is attached to the crib's balusters using straps and a Velcro™ securing means. Unlike the present invention, the crib bumper does not allow air to circulate through the entire bumper and only through a small portion of it, the crib bumper does not protect the baby from impacting the balusters above the bumper and the baby can still become lodged between the top of the bumper and the balusters.

U.S. Pat. No. 6,178,573 issued on Jan. 30, 2001 to Wagner et al., titled "VENTILATED UPGRADE KIT FOR A CRIB BUMPER AND METHOD OF USING IT" describes a partially ventilated crib bumper which is secured to the crib's balusters using tie strings, located on the bumper's outside fabric surface. Unlike the present invention, the crib bumper does not allow air to circulate through the entire bumper and only through a small portion of it, the crib bumper does not protect the baby from impacting the balusters above the bumper and the baby can still become lodged between the top of the bumper and the balusters.

U.S. Pat. No. D444,329 issued on Jul. 3, 2001 to Newman, titled "PROTECTIVE NET FOR INFANTS COT" shows a crib liner made of netting placed on the inside of the crib's side rail sections secured over the top of the top rail using a continuous top rail hook and extending down to the bottom rail. The two sides of the crib liner are secured to the outermost balusters using Velcro™ fasteners. Unlike the present invention, the crib bumper does not protect the baby from impacting the balusters or the corner posts.

U.S. Pat. No. 6,421,857 issued on Jul. 23, 2002 to Whatman et al., titled "LINER FOR AN INFANT BED" describes a rectangular crib liner made of a mesh material located on the inside of the crib and secured over the top of the top rails using hooks or a Velcro™ securing means. Unlike the present invention, the crib bumper does not protect the baby from impacting the balusters or the corner posts.

U.S. Pat. No. 6,438,775 issued on Aug. 27, 2002 to Koenig, titled "SLEEPING PAD, BEDDING AND BUMPERS TO IMPROVE RESPIRATORY EFFICIENCY AND ENVIRONMENTAL TEMPERATURE OF AN INFANT AND REDUCE THE RISKS OF SUDDEN INFANT DEATH SYNDROME (SIDS) AND ASPHYXIATION" describes individual baluster pads, ventilated bedding and a rectangular ventilated crib bumper which is secured to the crib's corner posts using Velcro™. Unlike the present invention, the patent does not protect the baby from impacting the balusters above the bumper and the baby can still become lodged between the top of the bumper and the balusters.

U.S. Pat. No. 6,564,403 issued on May 20, 2003 to Titus, titled "BABY BUMPER PAD" describes a one piece crib bumper which is secured to the crib's balusters using tie strings, located on the bumper's outside surface. A bottom panel is zipper attached to the crib bumper and fits between the mattress and the balusters. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 6,772,457 issued on Aug. 10, 2004 to Alaback, titled "BABY CRIB PAD" describes multiple crib pad segments which are secured together on the outside of the crib using Velcro™. Each crib pad segment has multiple padded flaps for securing around each baluster using a Velcro™ securing means. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 6,684,437 issued on Feb. 3, 2004 to Koenig, titled "SLEEPING PAD, BEDDING AND BUMPERS TO IMPROVE RESPIRATORY EFFICIENCY AND ENVIRONMENTAL TEMPERATURE OF AN INFANT AND REDUCE THE RISKS OF SUDDEN INFANT DEATH SYNDROME (SIDS) AND ASPHYXIATION" describes individual baluster pads, ventilated bedding and a rectangular ventilated crib bumper which is secured to the crib's corner posts using Velcro™. Unlike the present invention, the patent does not protect the baby from impacting the balusters above the bumper and the baby can still become lodged between the top of the bumper and the balusters.

U.S. Pat. No. 6,957,464 issued on Oct. 25, 2005 to Coauette, titled "CRIB BUMPER" describes a one piece box shaped bumper which is secured to the crib's balusters using tie strings, located on the bumper's outside surface. Open pockets on the outside of the bumper receive L-shaped inserts which are positioned between the balusters and underneath the mattress. Unlike the present invention, the crib bumper does not allow air to circulate through it, the crib bumper does not protect the baby from impacting the balusters above the bumper and the baby can still become lodged between the top of the bumper and the balusters.

U.S. Pat. No. 7,003,823 issued on Feb. 28, 2006 to Reed et al., titled "CRIB SAFETY NET" describes a rectangular box crib liner made of a mesh material located on the inside of the crib and secured over the top of the top rails using hooks or a Velcro™ securing means. The mattress is placed over the bottom of the rectangular box crib liner. Unlike the present invention, the crib bumper does not protect the baby from impacting the balusters or the corner posts.

U.S. Pat. No. 7,055,192 issued on Jun. 6, 2006 to Waters et al., titled "CRIB SHIELD SYSTEM AND OTHER BREATHABLE APPARATUS" describes crib shield panels made of a mesh material located on the inside of a crib and secured onto itself, onto the corner posts, onto the balusters or onto the horizontal rails using a Velcro™ securing means. Unlike the present invention, the crib bumper does not protect the baby from impacting the balusters or the corner posts.

U.S. Pat. No. 7,213,282 issued on May 8, 2007 to Wojtowicz, titled "CRIB ACCESSORY AND ASSEMBLY" describes a rectangular crib bumper with a bottom section which is secured to the crib's corner posts and balusters using a Velcro™ securing means, located on the bumper's outside surface. Unlike the present invention, the crib bumper does not allow air to circulate through the bumper, the crib bumper does not protect the baby from impacting the balusters above the bumper and the baby can still become lodged between the top of the bumper and the balusters.

All of the previously described prior art patents do not allow air to circulate through the crib bumper, or do not protect the baby from impacting the balusters above the crib bumper, or the baby can become lodged between the crib bumper and the mattress or between the top of the crib bumper and the balusters, or the baby can use the crib bumper as a step for crawling out of the crib and falling onto the floor.

Many other types of patents and innovations for enhancing the health and well being of a baby have been invented and patented in the past. Some of the more important prior art patents and innovations, in which the present invention improves upon, are briefly described hereafter.

U.S. Pat. No. 4,359,792 issued on Nov. 23, 1982 to Dale, titled "CRIB" describes a crib which replaces balusters in the head, foot and sides sections with mesh panels. The crib also has a pivoting canopy section which opens and closes the top of the crib. Unlike the present invention, the crib does not protect the baby from impacting the four corner posts.

U.S. Pat. No. 5,161,269 issued on Nov. 10, 1992 to McLean et al., titled "CRIB COVER" describes screen or mesh crib cover for preventing animals from entering a crib. The cover is secured to the top of the crib using Velcro™. Unlike the present invention, the crib cover does not protect the baby from impacting the balusters and corner posts, and the baby can still become lodged between the balusters.

U.S. Pat. No. 5,555,577 issued on Sep. 17, 1996 to Volpe, titled "CRIB ADAPTER" describes an air permeable sleeping surface suspended from the top of a crib's rails. The sleeping surface is secured to the top of the side rails using hooks. Unlike the present invention, the crib cover does not protect the baby from impacting the balusters and corner posts, and the baby can still become lodged between the balusters.

U.S. Pat. No. 5,699,571 issued on Dec. 23, 1997 to Yowell, titled "INFANT BEDDING APPARATUS" describes a mesh sleeping surface suspended in a crib above a mattress using a rectangular frame spacer or below a crib's top head and foot rails using long hooks. Unlike the present invention, the crib cover does not protect the baby from impacting the balusters and corner posts, and the baby can still become lodged between the balusters.

U.S. Pat. No. 6,256,813 issued on Jul. 10, 2001 to Aaron, titled "CRIB" describes a crib which replaces balusters in the head, foot and sides sections with mesh panels. Unlike the present invention, the crib does not protect the baby from impacting the four corner posts or the horizontal support rails behind the mesh panels.

Many other types of patents and innovations for protecting a baby from insects using mesh containment have been invented and patented in the past.

U.S. Pat. No. 1,264,734 issued on Apr. 30, 1918 to Williams, titled "INSECT SCREENS FOR CRIBS OR BEDS" describes screening mounted in wooden rectangular frames and positioned inside of a crib using brackets fastened to the corner posts. The top of the crib is covered with a two section screen panel hinged centrally to allow lifting a left or right section independently. Unlike the present invention, the screens mounted in wooden rectangular frames do not protect the baby from impacting the balusters and corner posts or the screen frames themselves.

U.S. Pat. No. 2,927,331 issued on Mar. 8, 1960 to Ruiz, titled "INSECT NETTING FOR CRIBS AND THE LIKE"

describes a six sided boxed netting enclosure suspended in a crib enclosure for receiving a mattress and a baby. The six sided boxed netting enclosure is secured to the top of the crib's four vertical corner posts using adjustable loops located on all four top corners. Zippered access to the six sided boxed netting enclosure is located on the front vertical section. The bottom section of the six sided boxed netting enclosure is a non-mesh fabric. Unlike the present invention, the six sided boxed netting enclosure does not protect the baby from impacting the balusters and corner posts.

U.S. Pat. No. 4,862,534 issued on Sep. 5, 1989 to Gomez-Marcial, titled "INSECT NETTING FOR A CRIB AND THE LIKE" describes a open bottom five sided boxed netting enclosure suspended in a crib enclosure. The open bottom five sided boxed netting enclosure is secured to the top of the crib's four vertical corner posts using adjustable loops and/or ties located on all four top corners. Zippered access to the open bottom five sided boxed netting enclosure is located on the top section. The bottom section of the open bottom five sided boxed netting enclosure use elasticized corners for an adjustable "fitted" fit. Unlike the present invention, the open bottom five sided boxed netting enclosure does not protect the baby from impacting the balusters and corner posts and small insects may still enter through the bottom fitted section.

U.S. Pat. No. 6,263,894 issued on Jul. 24, 2001 to LaMantia, titled "INSECT NETTING ASSEMBLY" describes a four sided netting enclosure fitted over the outside of a crib enclosure. The top of the four sided netting enclosure is stretchable band which reduces the openings diameter. Two connected and curved dowels support a tented netting dome shaped hood that fit around and over the top of the four sided netting enclosure. Unlike the present invention, the four sided netting enclosure does not protect the baby from impacting the balusters and corner posts and small insects may still enter through the bottom section.

U.S. Pat. No. 6,550,083 issued on Apr. 22, 2003 to LaMantia, titled "CRIB AND PLAYPEN PROTECTIVE COVERING" describes a five sided boxed netting enclosure connected to a tented netting dome shaped hood, supported with two connected and curved dowels, for receiving a mattress and a baby. The five sided boxed netting enclosure is secured to the top of the crib's side rails using Velcro™ straps and secured around the head and foot section of the crib using long Velcro™ straps. Zippered access to the tented netting dome shaped hood is located on the front section. Unlike the present invention, the six sided boxed netting enclosure does not protect the baby from impacting the balusters and corner posts.

U.S. Pat. No. 6,859,958 issued on Mar. 1, 2005 to LaMantia, titled "CRIB AND PLAYPEN PROTECTIVE ENCLOSURE" describes a five sided boxed netting enclosure connected to a tented netting dome shaped hood, supported with two connected and curved dowels, for receiving a mattress and a baby. The five sided boxed netting enclosure is secured to the top of the crib's side rails using Velcro™ straps and secured around the head and foot section of the crib using long Velcro™ straps. Zippered access to the tented netting dome shaped hood is located on the front section. Unlike the present invention, the six sided boxed netting enclosure does not protect the baby from impacting the balusters and corner posts.

Many solutions to improve existing prior art problems have been made, but many are not well suited for the standard crib design and for the needs of a baby inside a crib. An easier use breathable crib insert bumper is needed.

Without adequate ventilation inside a crib, using a non-porous non-breathable baby bumper, a baby re-breathes expired gasses, namely carbon dioxide, built up inside the crib compartment chamber. Sudden Infant Death Syndrome (SIDS) may be caused by the re-breathing of expired carbon dioxide and inadequate air circulation inside a crib compartment. Sleeping infants with low level intakes of oxygen and an increased re-breathing of carbon dioxide produces an anesthetic effect on a sleeping baby and may cause increased apneas (absences of breathing).

The earth's atmosphere is made up of 79% asphyxiant gases (mainly nitrogen), and around 21% oxygen, depending upon where you live. Carbon dioxide (CO2) is an asphyxiant gas and is about 1.5 times the density of air, which means it will settle in the lowest point it finds. Breathing carbon dioxide (CO2) concentrations in the air above 10% can be lethal.

No one knows exactly how Sudden Infant Death Syndrome happens, but the re-breathing of exhaled carbon dioxide has an anesthetic effect, creating a decrease in heart rate, brain function and breathing. The technical term for excessive carbon dioxide in the blood is called hypercarbia, which may lead to asphyxia, where the normal breathing reflex stops. Asphyxia is a condition of severely deficient supply of oxygen to the body. As a baby sleeps, the heavier than air exhaled carbon dioxide sits on the bottom of the four walled sealed crib chamber, causing the continual re-breathing of exhaled carbon dioxide. A baby sleeping on their stomach, re-breathes a higher percentage of exhaled carbon dioxide than a baby sleeping on their back does.

Hypoxia is the term to describe low oxygen levels in the blood. Hypercapnia is the term to describe high carbon dioxide (CO2) levels in the blood. Acidosis is the term to describe the buildup of lactic acid in the blood and tissues, a by-product of an anaerobic metabolism (without oxygen).

Human extremities can be deprived of blood flow for more than 30 minutes without damage. Breathing is triggered by rising carbon dioxide levels in the blood rather than diminishing oxygen levels. The central nervous system, specifically those portions involved in consciousness, will not continue to function for more than a few seconds without oxygen. The disruption of cell metabolism in the tissues and the accumulation of toxic by-products result in patho-physiological consequences such as tissue necrosis, loss of consciousness and death. Carbon dioxide dissolved in blood forms carbonic acid, which acidifies the blood. Too much of it causes acidosis, which can kill. Asphyxia causes hypoxia, which primarily affects the tissues and organs most sensitive to hypoxia, the brain, resulting in cerebral hypoxia.

Lack of oxygen, either partial [hypoxia] or total [anoxia], can cause death. Impairment of cognitive and motor function can manifest at oxygen concentrations of 10-15%. Loss of consciousness occurs at less than 10%. Death usually occurs at less than 8%. A person can lose consciousness in 40 seconds and die within a few minutes when ambient oxygen levels are as low as 4-6%.

Periodic pauses in breathing is a normal occurrence and is called apnea, the absence of breathing. It has been proven that increased levels of ambient oxygen reduces the occurrences of apnea in infants. This was the reason why newborns were placed in oxygen tents after birth more than 50 years ago, but the side effects were poor eye development and sometimes blindness would occur.

The American Academy of Pediatrics recommends that a baby be positioned on their back (supine position) when sleeping to reduce the possibility of Sudden Infant Death Syndrome (SIDS) occurring. It is recommended that you should not let a baby lie on their back to sleep when they are experiencing respiratory distress or have been just fed, in case of excessive regurgitation after feeding. It is also believed that excessive bedding and clothing produce hyperthermia, the overheating of a infant.

Interesting cases related to carbon dioxide asphyxiation have occurred in the past. Around 11:30 p.m. on Aug. 15, 1984, a carbon dioxide eruption occurred from the bottom of Lake Monoun, in west Africa, killing 37 people living around Lake Monoun. At 9:30 p.m. on Aug. 12, 1986, a cloudy mixture of carbon dioxide and water droplets rose violently from the deep waters of the tropical crater Lake Nyos, in Cameroon, west Africa. The heavier than air carbon dioxide cloud was about 50 meters thick. It quickly enveloped houses within the crater that were 120 meters above the shoreline of the lake. The Lake Nyos lethal gas cloud of carbon dioxide was estimated to be filled with around 1,940,000 tons of carbon dioxide. Part of the carbon dioxide cloud escaped over a low spillway, cut in the northern rim of the maar crater, and flowed down the slopes into the valleys below at a rate of 20 to 50 km per hour, towards the villages of Nyos, Kam, Cha, and Subum. The deadly carbon dioxide cloud traveled more than 23 km, bringing sudden death to all life in the vicinity. 1,746 people, thousands of cattle, birds, animals and insects died of carbon dioxide induced asphyxiation. Children are often the first victims because they breathe air nearest the earth. It was estimated that a liter of water, in the lower part of the lake, contained between 1 to 5 liters of dissolved carbon dioxide ($CO_2$).

The US Federal Mine Safety and Health Act of 1977 established ventilation standards in which mines should be ventilated by a current of air containing not less than 19.5 volume per centum of oxygen and not more than 0.5 volume per centum of carbon dioxide ($CO_2$).

SUMMARY OF THE INVENTION

The following descriptions of the preferred embodiments of the present invention are all manufactured using four connected breathable fabric mesh panels, preferably a nylon mesh screen material or secondly a polyester mesh screen material, to increase air circulation inside the crib compartment and to prevent the re-breathing of expired carbon dioxide gas.

The crib dimensions used throughout the world vary, but most cribs in the United States accept the standard rectangular crib mattress size. The crib mattress is positioned on an immovable support spring, lattice support attached to the crib's lower horizontal rail section or on a vertically adjustable horizontal support member attached to the crib's lower horizontal rail section. The distance from the top of the mattress to the top rail of the crib varies, depending on the height of the side rails or on the position of the vertically adjustable horizontal support member attached to the crib's lower horizontal rail section.

The present invention uses the same concept used in a boxing ring. A boxing ring uses padded rope sections suspended inside four vertical posts producing a square shaped ring for absorbing the impact of a body coming in contact with the boxing ring's ropes. The present invention uses four connected vertical panels made out of rectangular shaped breathable mesh fabric. The mesh fabric is preferably a nylon mesh screen material or some other material such as a polyester mesh. The four connected vertical panels are attached to and suspended from the inside of the crib's four vertical posts. The four connected vertical panels are attached from the top of and from the bottom of the vertical posts using adjustable straps or a fastening means. The four top and four bottom adjustable straps or fastening means are preferably sewn onto the outside edges and/or inside corners of the rectangular shaped breathable mesh fabric bumper sections. The four top and four bottom adjustable straps or fastening means are preferably held in place on the crib's four vertical posts using an adjustable hook and loop Velcro™ fastening means, buckle or other means of fastening and securing the mesh crib bumper tautly to the crib's four corner posts.

The breathable mesh crib bumper, when attached and secured into place, provides a rigid but slightly flexible barrier, keeping a baby from coming in contact with the balusters and corner posts. If a baby were to fall against the vertical walls of the breathable mesh crib bumper, the impact would be absorbed by the taut flexible mesh walls and would act as a type of shock absorber or trampoline surface.

Detaching the removably attached breathable mesh fabric crib bumper device from the crib frame support structure, allows the device to be washed when dirty. After removing the breathable mesh fabric crib bumper device from the crib, all closable seam means (buttons, zippers, buckles, snaps, hook and loop Velcro™ fasteners, etc.) should preferably be sealed closed before washing the device, preventing non-mating closure means and fasteners from becoming entangled with each other or from damaging the crib bumper's parts.

Another embodiment of the present invention can be manufactured with a breathable mesh fabric base attached to the bottom of all four vertical mesh panels. The suspended breathable mesh fabric base can come in direct contact with the crib mattress or can be suspended above the crib mattress. The four sided mesh bumper with the mesh base can also be used in a crib without using a mattress, allowing the mesh base to be used as the sleeping surface. If a baby became positioned on their stomach while sleeping, the baby will be able to continue breathing through the mesh base while facing downward, preventing the possibility of Sudden Infant Death Syndrome (SIDS) or asphyxiation.

Another embodiment of the present invention using the four sided mesh bumper with the mesh base, can also be manufactured with a breathable mesh fabric cover removably attached to the upper sections on all four vertical walls, preventing objects, animals or insects from entering the completely encapsulated breathable mesh fabric containment area.

Other embodiments of the present invention, can be modified to attach inside cribs without four corner posts or inside rectangular support structures. Some cribs have head and foot panels which are solid panels and other cribs have back side panels which are solid panels. To attach the mesh crib bumper to a crib with a vertical solid panel section, two lengths of strapping to wrap around the outside of the vertical solid panel section are needed. When installing the mesh crib bumper, the installer places the two lengths of strapping on the outside of the vertical solid panel section and places the four ends, on the two lengths of strapping, through the four strap connecting buckles or fastening means and tightens the straps until the four vertical mesh panels are taut. To ensure the safety if the child while in the crib, all lengths of strapping longer than six inches should be cut to a length less than six inches. If the strap ends become frayed, cutting the frayed edges and then using a lighter or a match to melt the edges will prevent future fraying.

Modifications of the present invention can also include using a mesh fabric wrapped around a horizontal and vertical support structure, preferably four breathable perforated foam panels, inflatable bladders, etc. and installing the mesh crib bumper inside a crib by securing four vertical mesh panels to the four vertical corner posts or vertical balusters.

It is an object of the present invention to provide a mesh crib bumper insert enclosure which is breathable and that air circulates through the enclosure's mesh walls.

It is another object of the present invention to provide a breathable crib bumper insert enclosure that prevents a baby from impacting their head or appendages against a crib's balusters or crib posts.

It is still another object of the present invention to provide a breathable crib bumper insert enclosure that prevents a baby from sticking their head or appendages through a crib's balusters.

It is yet another object of the present invention to provide a breathable mesh crib bumper enclosure that is installed into and removed out of the crib fast and easily, for crib maintenance and for the cleaning of the mesh crib bumper.

It is a further object of the present invention to provide a breathable mesh crib bumper enclosure that spaces the vertical mesh panels at least an inch or two away from the cribs vertical posts and balusters.

It is yet a further object of the present invention to provide a breathable mesh crib bumper enclosure also including a lower horizontal surface base for laying a baby onto or for positioning the mesh fabric base on top of a mattress.

Finally, it is a another object of the present invention to provide a breathable mesh crib bumper sealed enclosure including four walls, a lower horizontal surface and a re-sealable top horizontal cover for keeping insects and animals out of the crib's breathable enclosure.

The present invention and many preferred embodiments of the present invention all use a taut breathable mesh fabric enclosure secured to four posts and horizontal rails for preventing an object from getting in or out of the enclosure, or from an object within the enclosure coming in contact with another object located outside the enclosure.

These and other objects, features and advantages of the present invention are provided within this patent application and will be better understood in connection with the following drawings and descriptions of the preferred embodiments. Additional objects of the present invention will become apparent as the description proceeds.

It is to be understood that the present invention is not limited in its application to the details of construction and to the arrangements of the components set forth in the following description or illustrated in the drawings. The present invention is capable of other embodiments and of being practiced and carried out in various ways. It should be also understood that the phraseology and terminology used in this patent application are for the purpose of describing and claiming the present invention and should not be regarded as limiting.

DESCRIPTION OF THE DRAWINGS

For a better understanding of the invention as well as other objects, features and advantages thereof, reference is made to the following detailed description to be read in conjunction with the accompanying drawings, wherein.

LIST OF REFERENCE NUMBERING

1 labels a crib.
2 labels a crib mattress.
3 labels a mesh crib bumper.
10 labels a vertical crib corner post.
12 labels a top horizontal crib rail.
14 labels a bottom horizontal crib rail.
16 labels a vertical crib baluster.
20 labels a top edge of a crib mattress.
22 labels a crib mattress platform.
24 labels a crib mattress platform vertical support edge.
30 labels a vertical breathable mesh fabric panel.
32 labels a top horizontal strap for the breathable mesh fabric panel.
34 labels a bottom horizontal strap for the breathable mesh fabric panel.
36 labels a vertical strap for securing the mesh fabric panel to the crib.
38 labels a mesh panel corner pocket for receiving a vertical support member.
39 labels a vertical support member for the mesh fabric panel.
40 labels a strap connecting buckle.
42 labels a strap end sewn around the strap connecting buckle.
44 labels a strap end fed through the connecting buckle.
46 labels a hook Velcro™ fastener strip sewn onto the outside end of a strap.
48 labels a loop Velcro™ fastener strip sewn onto the outside surface of a strap.
50 labels a hook Velcro™ fastener strip sewn onto the inside mesh fabric panel top.
52 labels tie string fasteners for securing the bumper to the bottom crib rails.
54 labels a horizontal support member for the head and foot mesh fabric panel.
56 labels a horizontal support member for the side mesh fabric panels.
60 labels a mesh fabric panel base.
**60*b*** labels a secondary mesh fabric panel base fur use without a mattress.
62 labels a mesh fabric panel lid.
64 labels mesh fabric extension panels which extend over the crib's top rail.
66 labels a double bar buckle.

DETAILED DESCRIPTION OF THE PREFERRED EMBODIMENT

In order to more fully understand the invention, during the course of this description, the mesh crib bumper and enclosure invention and preferred embodiments, will be labeled and explained to easily identify like elements according to the different figures which illustrate some of the preferred embodiments of the invention. It is apparent that FIGS. 1-18 all show breathable mesh panels spaced away from any hard surface inside a crib or support structure. Additional objects of the present invention will become apparent as the description proceeds.

Figure 1:
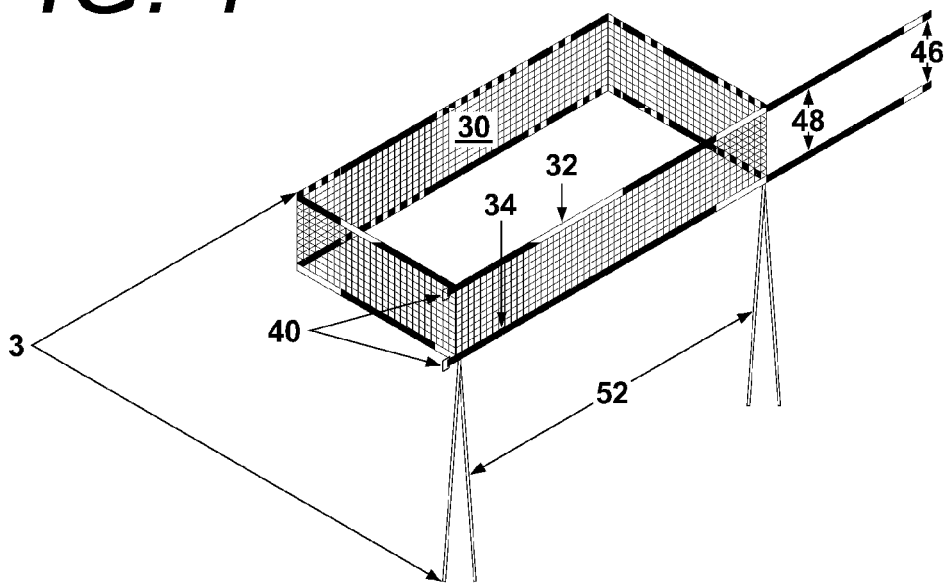
FIG. 1 shows a perspective view of the present invention, depicting a standard crib without a mattress support, a crib mattress and a mesh crib bumper showing only the front panel with horizontal fastening straps, and tie string fasteners for securing the mesh crib bumper to the bottom crib rail.
Figure 1:
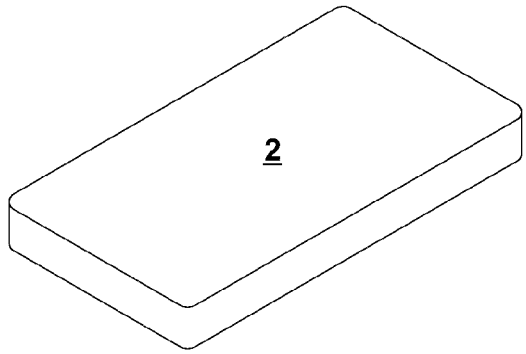
Figure 1:
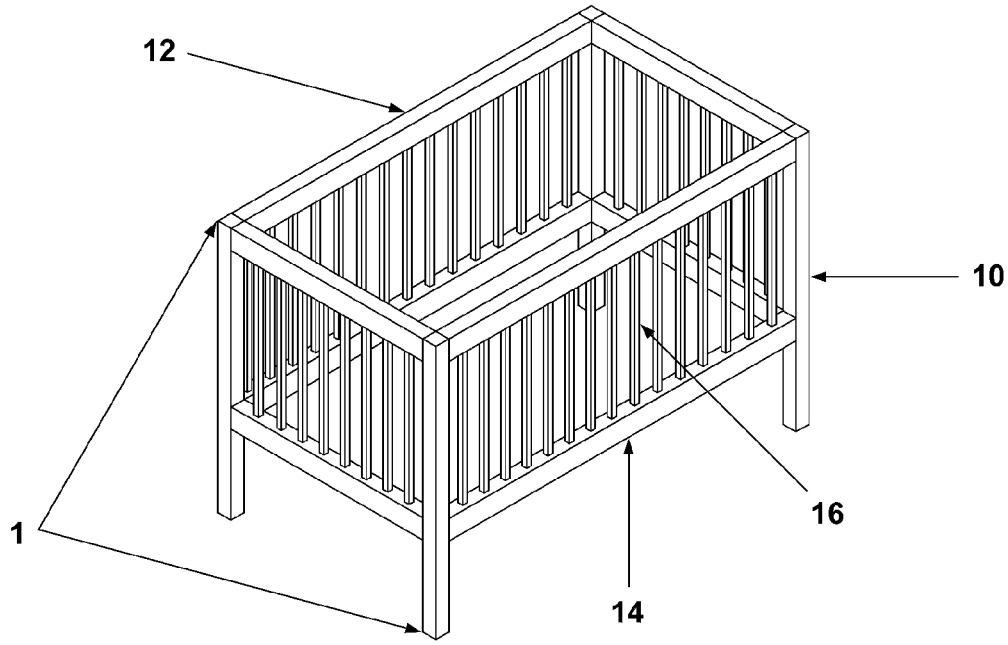

Referring to FIG. 1, there is shown a front elevational view of a rectangular crib 1 having four vertical corner posts 10 extending from the floor to the top horizontal crib rails 12, and having four bottom horizontal crib rails 14 with vertical crib balusters 16 connecting the top and bottom crib rails 12 and 14. The rectangular crib 1 receives a rectangular crib mattress 2 which sits on an immovable support spring or lattice attached to the crib's lower horizontal rail section 14 or on a vertically adjustable horizontal support member attached to the crib's lower horizontal rail section 14. The immovable mattress support or vertically adjustable horizontal mattress support member is not shown. The breathable mesh crib bumper 3 is positioned and secured inside of the rectangular crib 1 from four vertical corner posts 10, preferably when the baby is not in the crib 1 and the crib mattress 2 is covered with a waterproof barrier, sheets and/or bedding. The mesh crib bumper 3 has four vertical mesh panels 30 connected at four vertical corners or a continuous vertical mesh panel 30 connected at one of the vertical corners The crib securing method uses four adjustable bottom straps 34 with a fastening means 40 at one end, preferably a buckle device, and a length of strap to wrap around an outside vertical corner post 10 and feed through and secure to the fastening means 40; and four adjustable top straps 32 with a fastening means 40 at one end, preferably a buckle device, and a length of strap to wrap around an outside vertical corner post 10 and feed through and secure to the fastening means 40. The fastening means 40 in FIG. 1 shows a belt loop and a length of the top strap 32 and a length of the bottom strap 34 to feed through and secure to the fastening means 40, with a hook Velcro™ fastener strip 46 sewn onto the outside end of a top strap 32 and bottom strap 34 and a loop Velcro™ fastener strip 48 sewn onto the outside surface of a top strap 32 and bottom strap 34. The fastening means 40 can also use a self locking buckle to increase manufacturing times and reduce manufacturing costs. The bottom edge of the mesh crib bumper 3 device is preferably vertically secured onto the top surface of the mattress 2 using four adjustable fastening means 52, preferably tie string fasteners, located on the four bottom edge corners, for securing the mesh crib bumper 3 to the bottom crib rails 14. The mesh crib bumper 3 device can also be vertically secured onto the top surface of the mattress 2 without the four attached adjustable fastening means 52, using shoe strings of an appropriate length or some other length of material wrapped around, over or through the four bottom fastening means 40 and tied around the four bottom horizontal crib rails 14 until the bottom edge of the mesh crib bumper 3 is vertically secured onto the top surface of the mattress 2.

Figure 2:
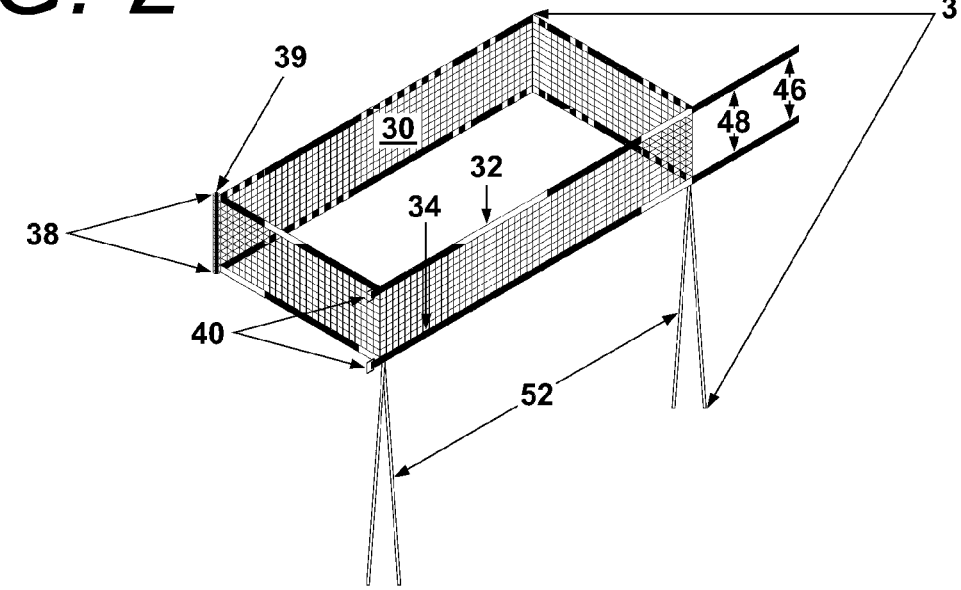
FIG. 2 shows a perspective view of the present invention, depicting a standard crib without a mattress support, a crib mattress and a mesh crib bumper showing only the front panel with horizontal fastening straps, and tie string fasteners for securing the mesh crib bumper to the bottom crib rail, and one corner having a pocket for receiving a vertical support member.
Figure 2:
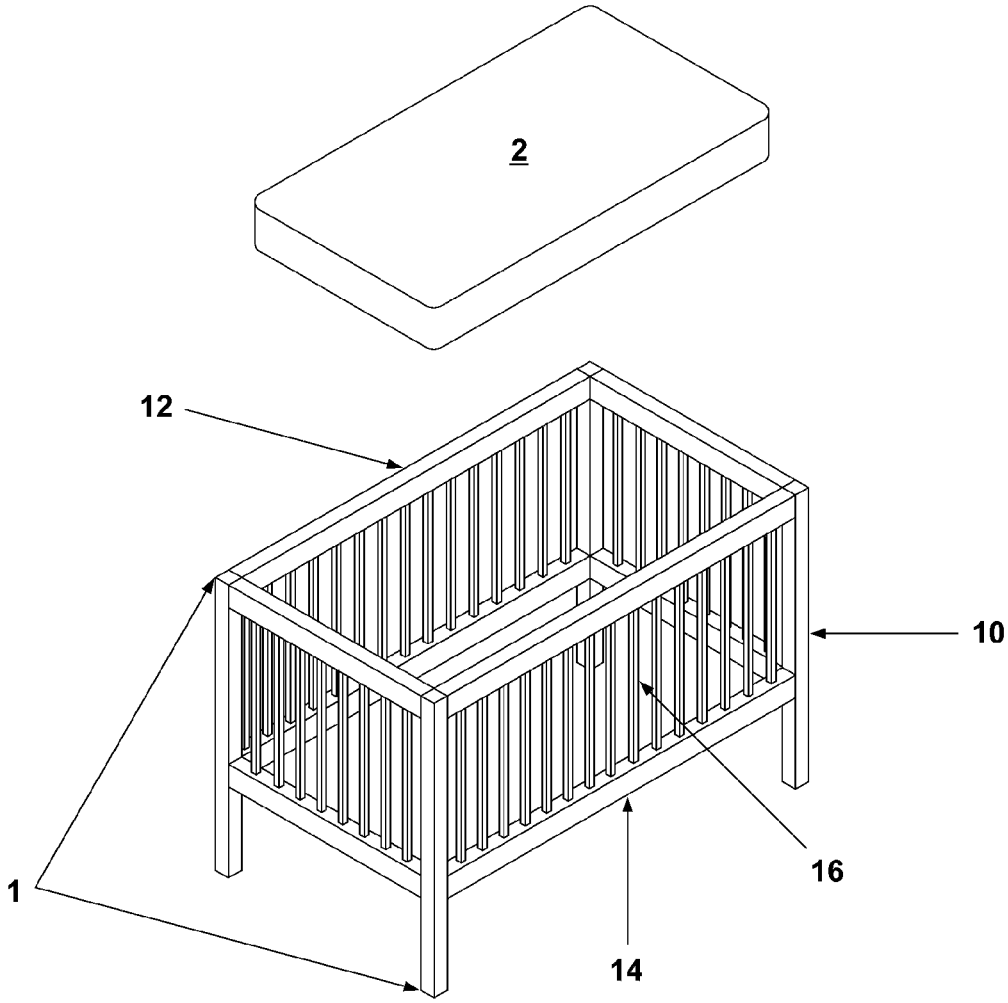

Referring to FIG. 2, there is shown a front elevational view of FIG. 1 with the four connected vertical mesh panels 30 having four vertical corner pockets 38 for receiving a vertical support member 39 to prevent the four connected vertical mesh panels 30 from being vertically compressed and to maintain horizontal and vertical tension of the four vertical mesh panels 30.

Figure 3:
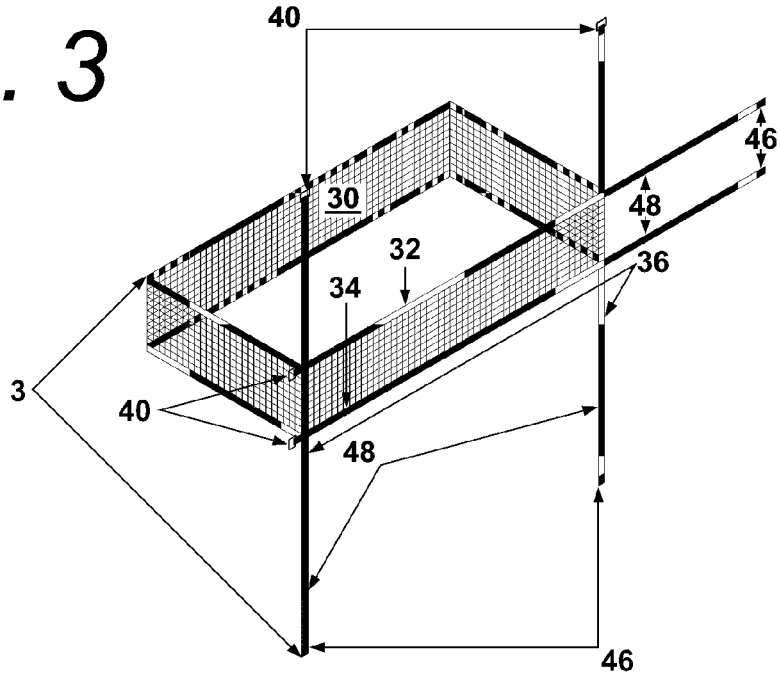
FIG. 3 shows a perspective view of the present invention, depicting a standard crib without a mattress support, a crib mattress and a mesh crib bumper showing only the front panel with horizontal and vertical connecting straps.
Figure 3:
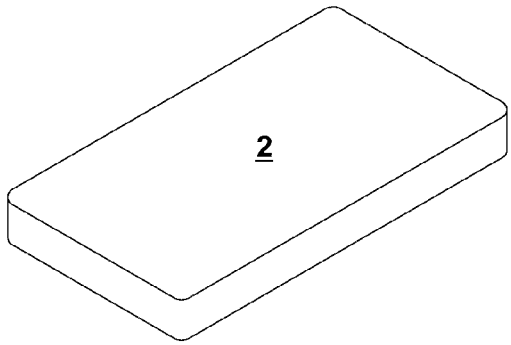
Figure 3:
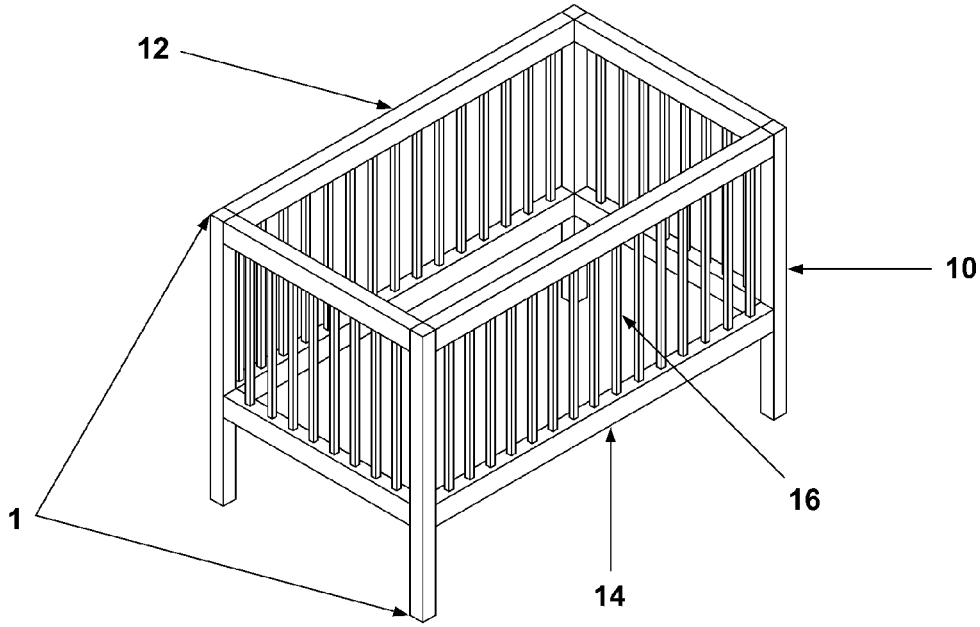

Referring to FIG. 3, there is shown a front elevational view of FIG. 1 without the four adjustable fastening means 52, preferably tie string fasteners, located on the four bottom edge corners, for securing the mesh crib bumper 3 to the bottom crib rails 14. The four connected vertical mesh panels 30 have eight adjustable vertical straps 36, two on each corner, for wrapping around a top rail 12 and a bottom rail 14 of the crib 1. The eight adjustable vertical straps 36 with a fastening means 40 at one end to wrap over a top rail 12, preferably a the buckle device, and a length of strap to wrap around a bottom rail 14 and feed through and secure to the fastening means 40. The fastening means 40 in FIG. 3 shows a belt loop and a length of the eight vertical straps 36 to feed through and secure to the fastening means 40, with a hook Velcro™ fastener strip 46 sewn onto the outside end of eight adjustable vertical straps 36 and a loop Velcro™ fastener strip 48 sewn onto the outside surface of eight adjustable vertical straps 36.

Figure 4:
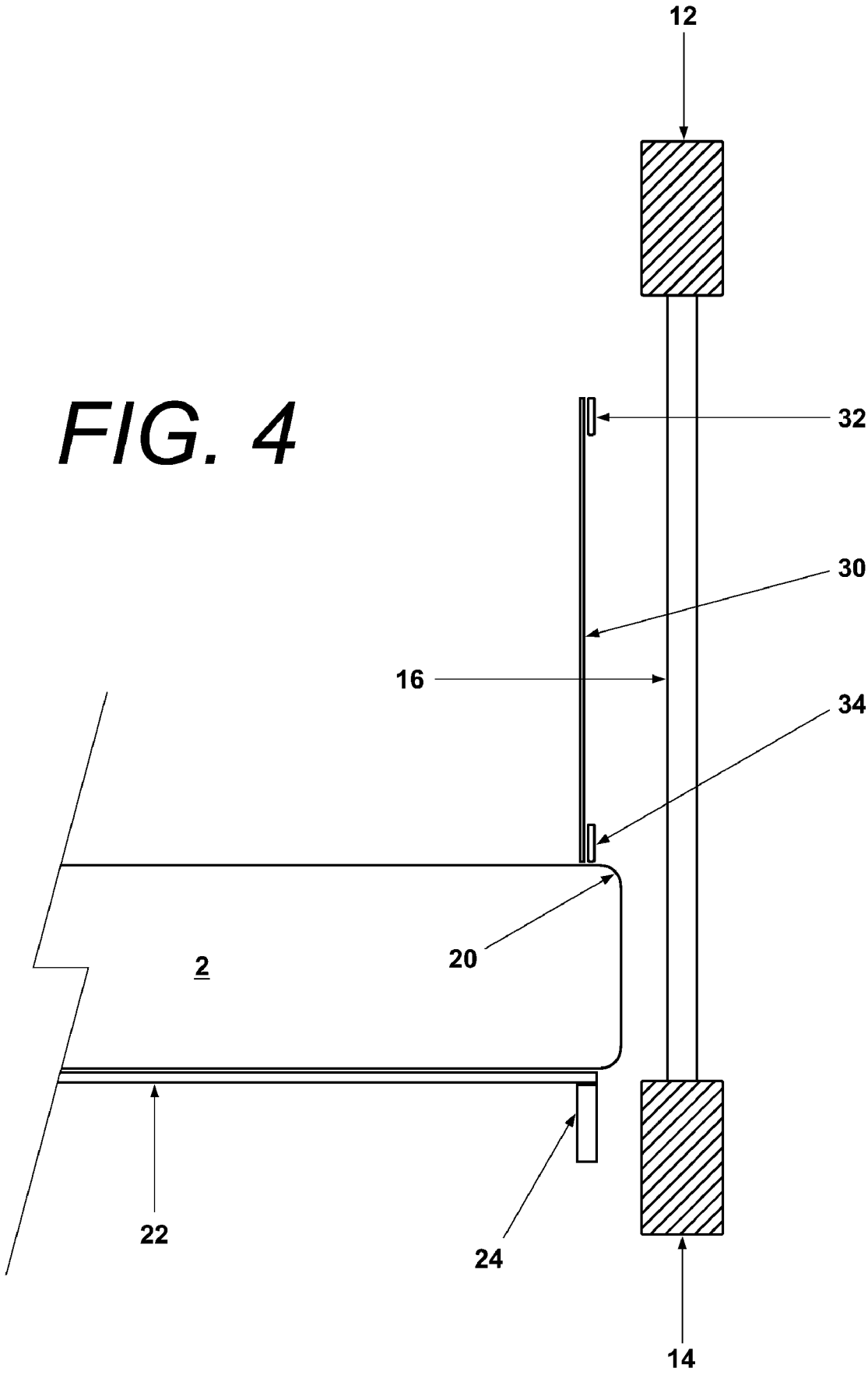
FIG. 4 shows a cross sectional view of the present invention, depicting a mesh crib bumper, with horizontal straps sewn onto the top and bottom edges, installed inside a crib on top of a crib mattress.

Referring to FIG. 4, there is shown a cross sectional view of FIGS. 1-3. The mesh crib bumper 3 is installed inside a rectangular crib 1 with four top horizontal crib rails 12 and four bottom horizontal crib rails 14 with vertical crib balusters 16 connecting the top and bottom crib rails 12 and 14. The rectangular crib 1 receives a rectangular crib mattress 2 which sits on an immovable support spring or lattice attached to the crib's lower horizontal rail section 14 or on a structurally reinforced edge 24 vertically adjustable horizontal support member 22 attached to the crib's lower horizontal rail section 14. The mesh crib bumper 3 has four vertical mesh panels 30 connected at four vertical corners and preferably a securing method attached to the four corners of the four adjustable bottom horizontal straps 34 for securing the mesh crib bumper 3 to the bottom of the crib rails 14. The bottom edge of the horizontal strap 34 is preferably positioned on top of the inside surface of the mattress top edge 20.

Figure 5:
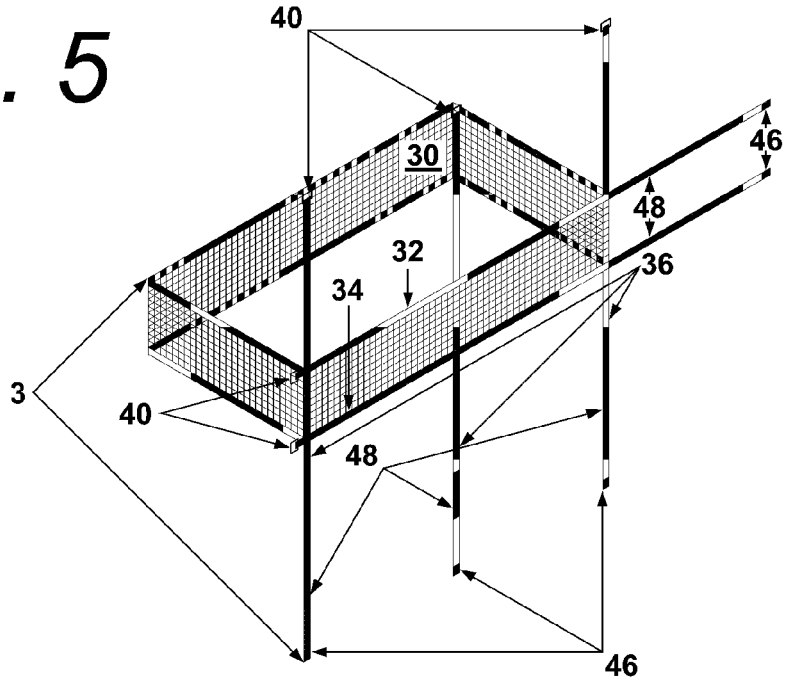
FIG. 5 shows a perspective view of another embodiment of the present invention, depicting a standard crib without a mattress support, a crib mattress and a mesh crib bumper showing only the front panel with horizontal and vertical connecting straps.
Figure 5:
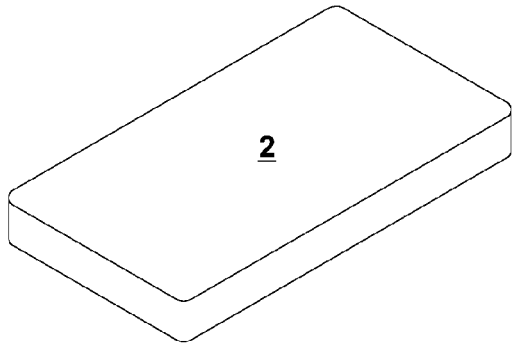
Figure 5:
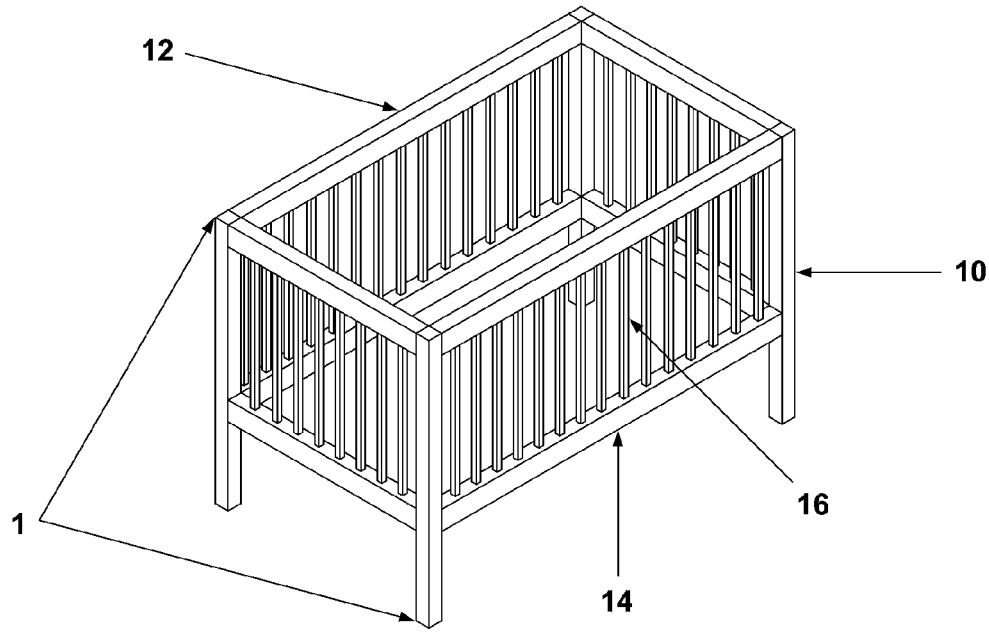

Referring to FIG. 5, there is shown a front elevational view of FIG. 3 where an additional adjustable vertical strap 36, one for each side mesh panel 30, for wrapping around a top rail 12 and a bottom rail 14 of the crib 1 and preventing each side mesh panel 30 from being vertically compressed.

Figure 6:
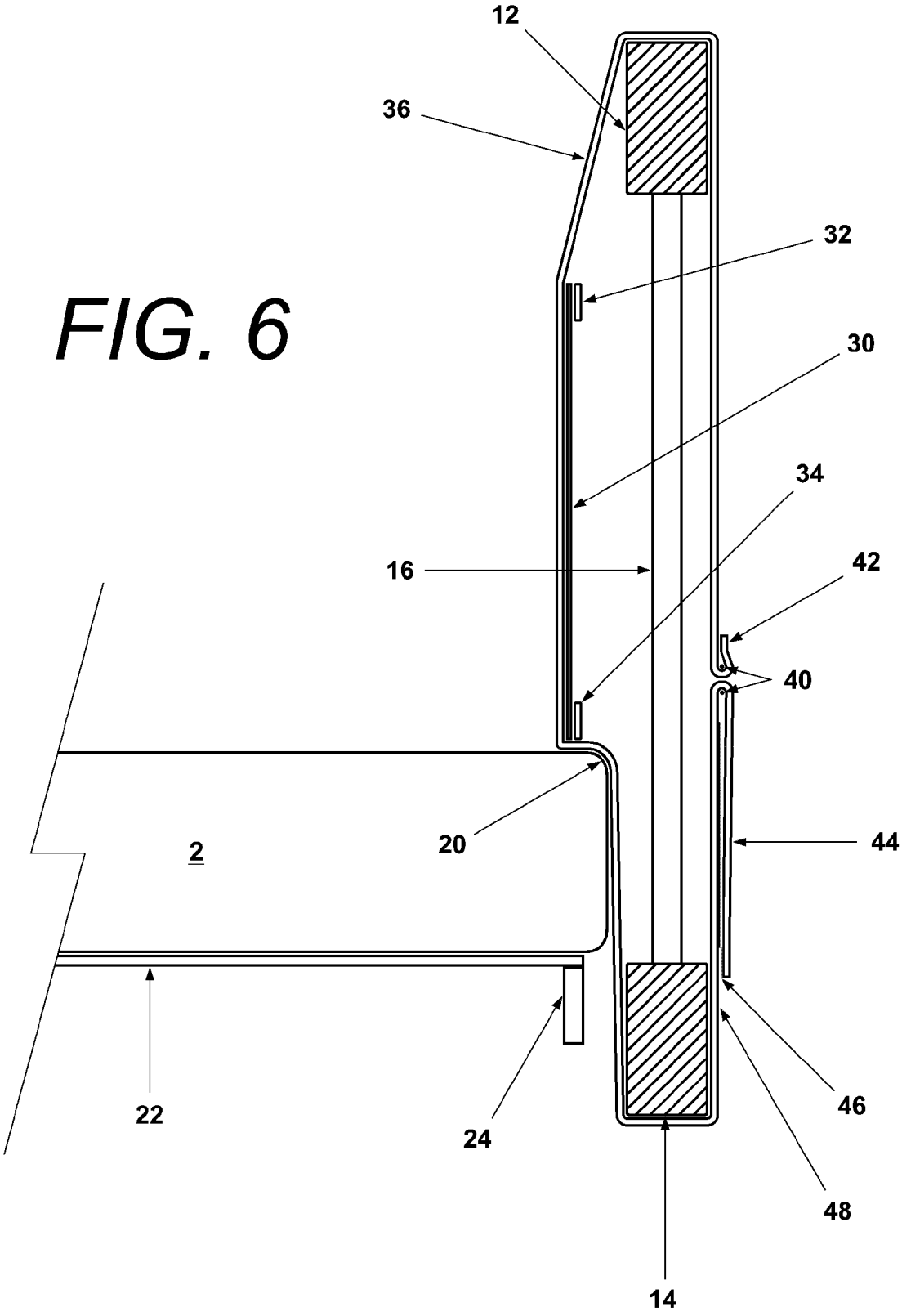
FIG. 6 shows a cross sectional view of the present invention, depicting a mesh crib bumper, with horizontal straps sewn onto the top and bottom edges and vertical support straps sewn onto the inside surface of the mesh crib bumper, installed inside a crib on top of a crib mattress.

Referring to FIG. 6, there is shown a cross sectional view of FIG. 3 and FIG. 5. The mesh crib bumper 3 is installed inside a rectangular crib 1 with four top horizontal crib rails 12 and four bottom horizontal crib rails 14 with vertical crib balusters 16 connecting the top and bottom crib rails 12 and 14. The rectangular crib 1 receives a rectangular crib mattress 2 which sits on an immovable support spring or lattice attached to the crib's lower horizontal rail section 14 or on a structurally reinforced edge 24 vertically adjustable horizontal support member 22 attached to the crib's lower horizontal rail section 14. The mesh crib bumper 3 has four vertical mesh panels 30 connected at four vertical corners and preferably a securing method attached to the four corners of the four adjustable bottom horizontal straps 34 for securing the mesh crib bumper 3 to the bottom of the crib rails 14. The bottom edge of the horizontal strap 34 is preferably positioned on top of the inside surface of the mattress top edge 20. Vertical straps 36 are attached to the inside or outside surfaces of the vertical mesh panels 30. The vertical straps 36 wrap around the top of the top rail 12 and the bottom of the bottom rail 14 and are attached on the outside of the crib 1. The end of the vertical strap 36, wrapped around the top of the top rail 12, preferably uses a strap connecting buckle 40 sewn onto the vertical strap end 42. The opposite vertical strap end 44 of the vertical strap 36, wrapped around the bottom of the bottom rail 14, is inserted through the connecting buckle 40, and using a hook 46 and loop 48 securing means.

Figure 7:
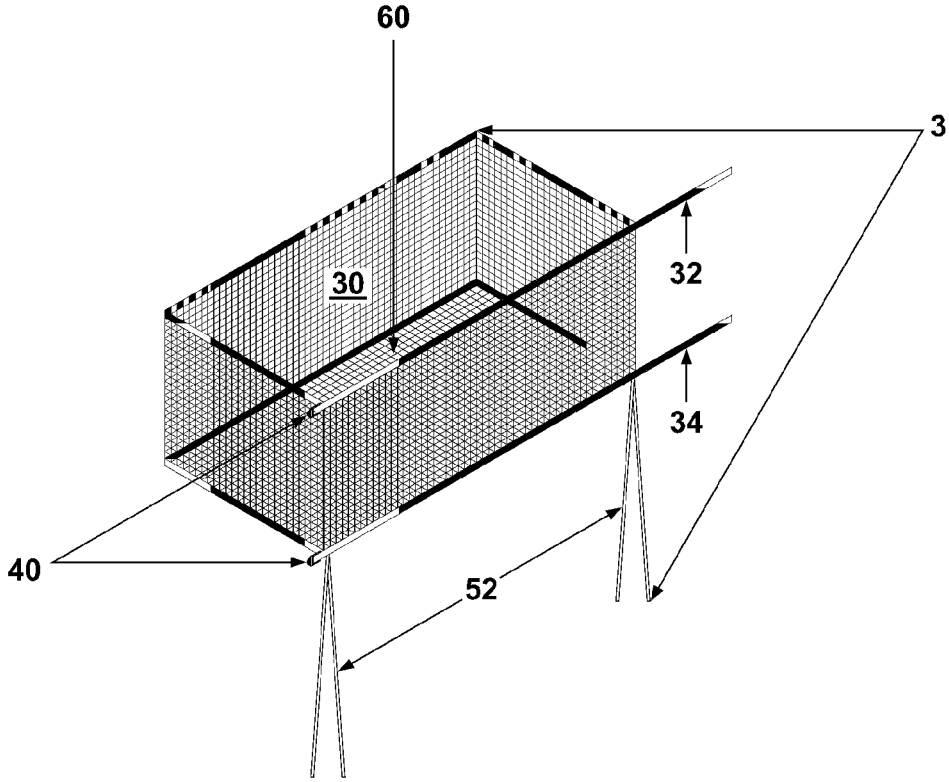
FIG. 7 shows a perspective view of the present invention, depicting a standard crib without a mattress support, and a mesh crib bumper with a mesh fabric base showing only the front panel with horizontal fastening straps, and tie string fasteners for securing the mesh crib bumper to the bottom crib rail.
Figure 7:
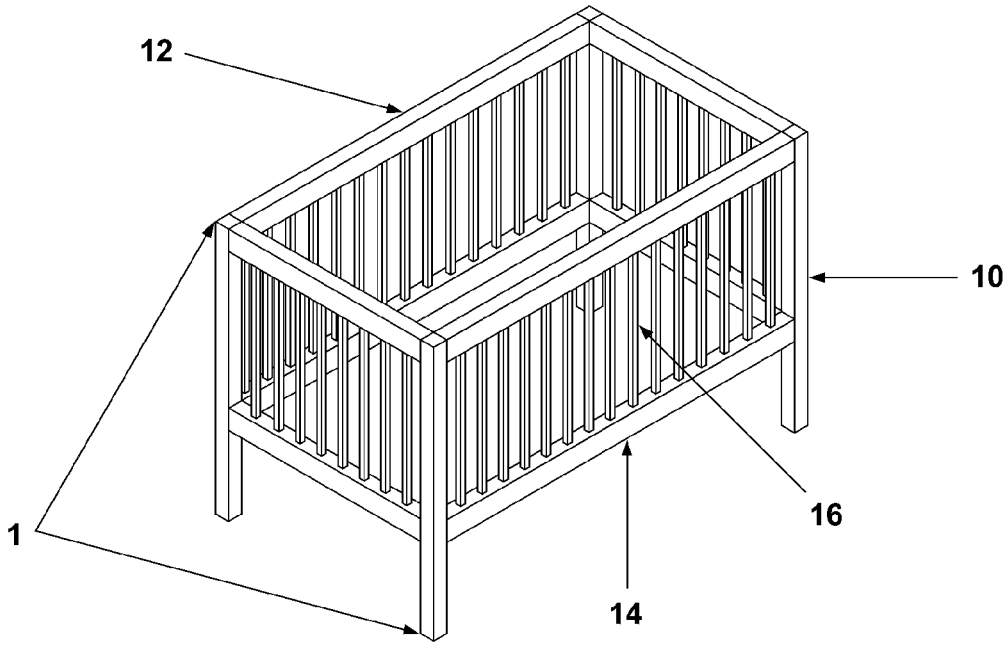

Referring to FIG. 7, there is shown a front elevational view of FIG. 1 where the four vertical mesh panels 30 are approximately twice the height of the four vertical mesh panels 30 in FIG. 1, a mesh panel base 60 is attached the bottom edges of the four vertical mesh panels 30 and the fastening means 40 uses a double bar buckle at the fastening end.

Figure 8:
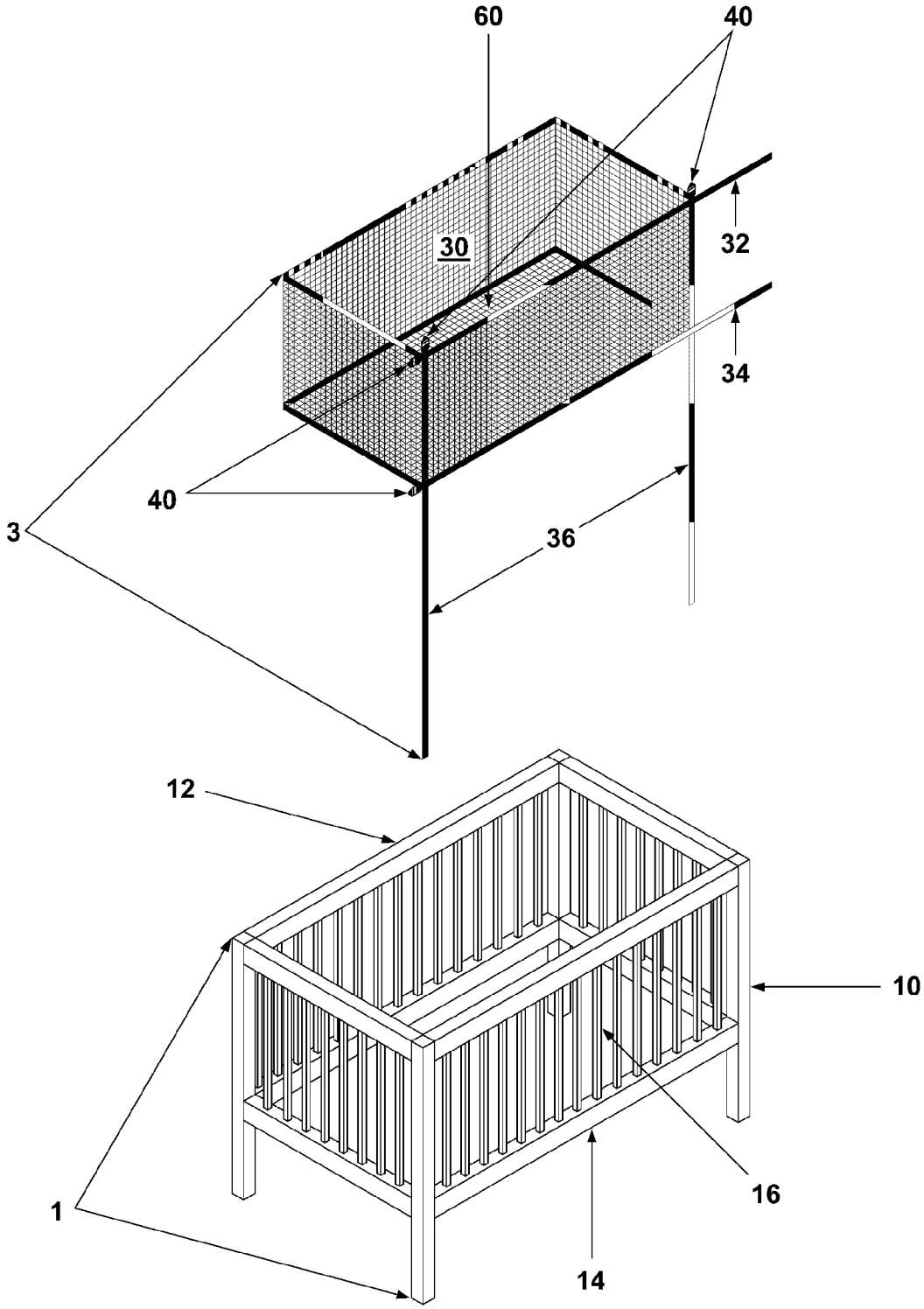
FIG. 8 shows a perspective view of the present invention, depicting a standard crib without a mattress support, and a mesh crib bumper with a mesh fabric base showing only the front panel with horizontal fastening straps, and vertical fastening straps for securing the mesh crib bumper to the bottom crib rail.

Referring to FIG. 8, there is shown a front elevational view of FIG. 7 without the four adjustable fastening means 52, preferably tie string fasteners, located on the four bottom edge corners, for securing the mesh crib bumper 3 to the bottom crib rails 14. The four connected vertical mesh panels 30 have eight adjustable vertical straps 36, two on each corner, for wrapping around a top rail 12 and a bottom rail 14 of the crib 1. The eight adjustable vertical straps 36 with a fastening means 40 at one end to wrap over a top rail 12, preferably a double bar buckle, and a length of strap to wrap around a bottom rail 14 and feed through and secure to the fastening means 40.

Figure 9:
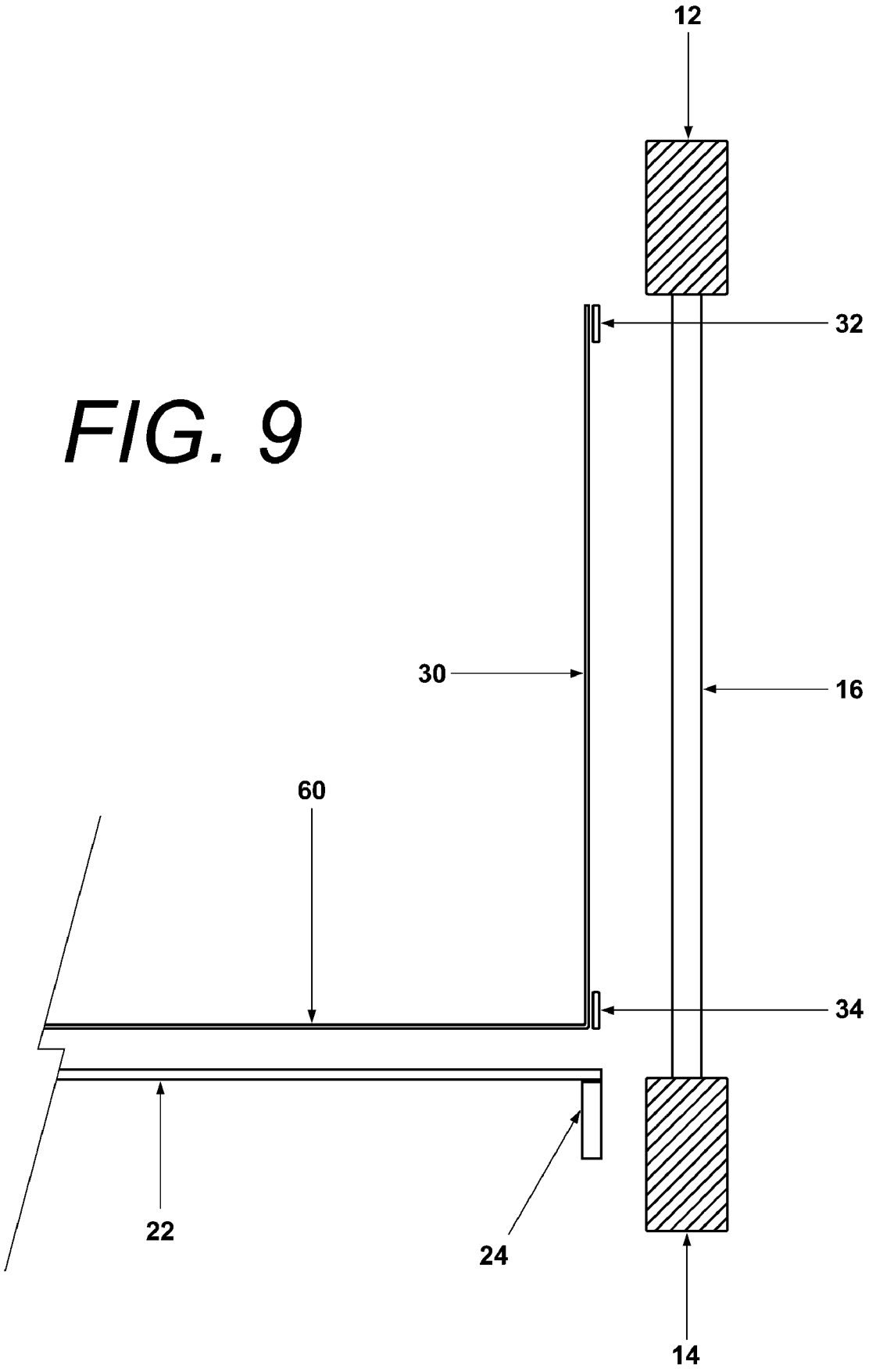
FIG. 9 shows a cross sectional view of the present invention, depicting a mesh crib bumper with an attached mesh panel base, with horizontal straps sewn onto the top and bottom edges, installed inside a crib.

Referring to FIG. 9, there is shown a cross sectional view of FIG. 7 and FIG. 8. The mesh crib bumper 3 is installed inside a rectangular crib 1 with four top horizontal crib rails 12 and four bottom horizontal crib rails 14 with vertical crib balusters 16 connecting the top and bottom crib rails 12 and 14. The rectangular crib 1 has an immovable support spring or lattice attached to the crib's lower horizontal rail section 14 or on a structurally reinforced edge 24 vertically adjustable horizontal support member 22 attached to the crib's lower horizontal rail section 14. The mesh crib bumper 3 has a bottom mesh panel base 60 attached to the bottom of the four connected vertical mesh panels 30 for laying a baby onto.

Figure 10:
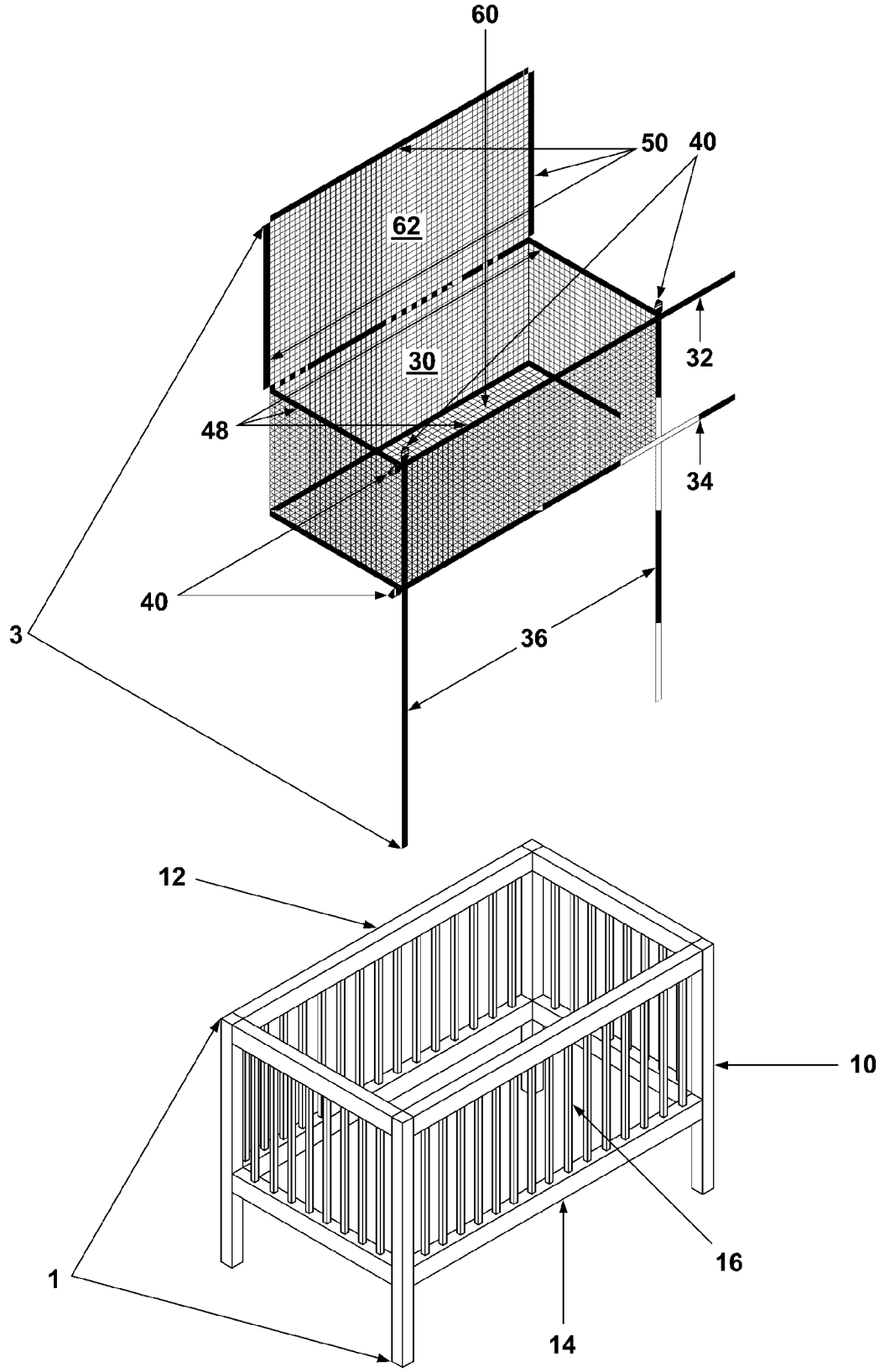
FIG. 10 shows a perspective view of the present invention, depicting a standard crib without a mattress support, and a mesh crib bumper with a mesh fabric base and a re-sealable top panel showing only the front panel with horizontal fastening straps, and vertical fastening straps for securing the mesh crib bumper to the bottom crib rail.

Referring to FIG. 10, there is shown a front elevational view of FIG. 8 with a top mesh panel 62 attached to the top edge on the back vertical mesh panel 30. The left, right and front edges of the top mesh panel 62 have a hook Velcro™ fastener strip 50 sewn onto the inside surface of the mesh fabric panel top 62. The four connected vertical mesh panels 30 have a loop Velcro™ fastener strip 48 sewn onto the outside surface of the connected vertical mesh panels 30 on the left, right and front edges.

Figure 11:
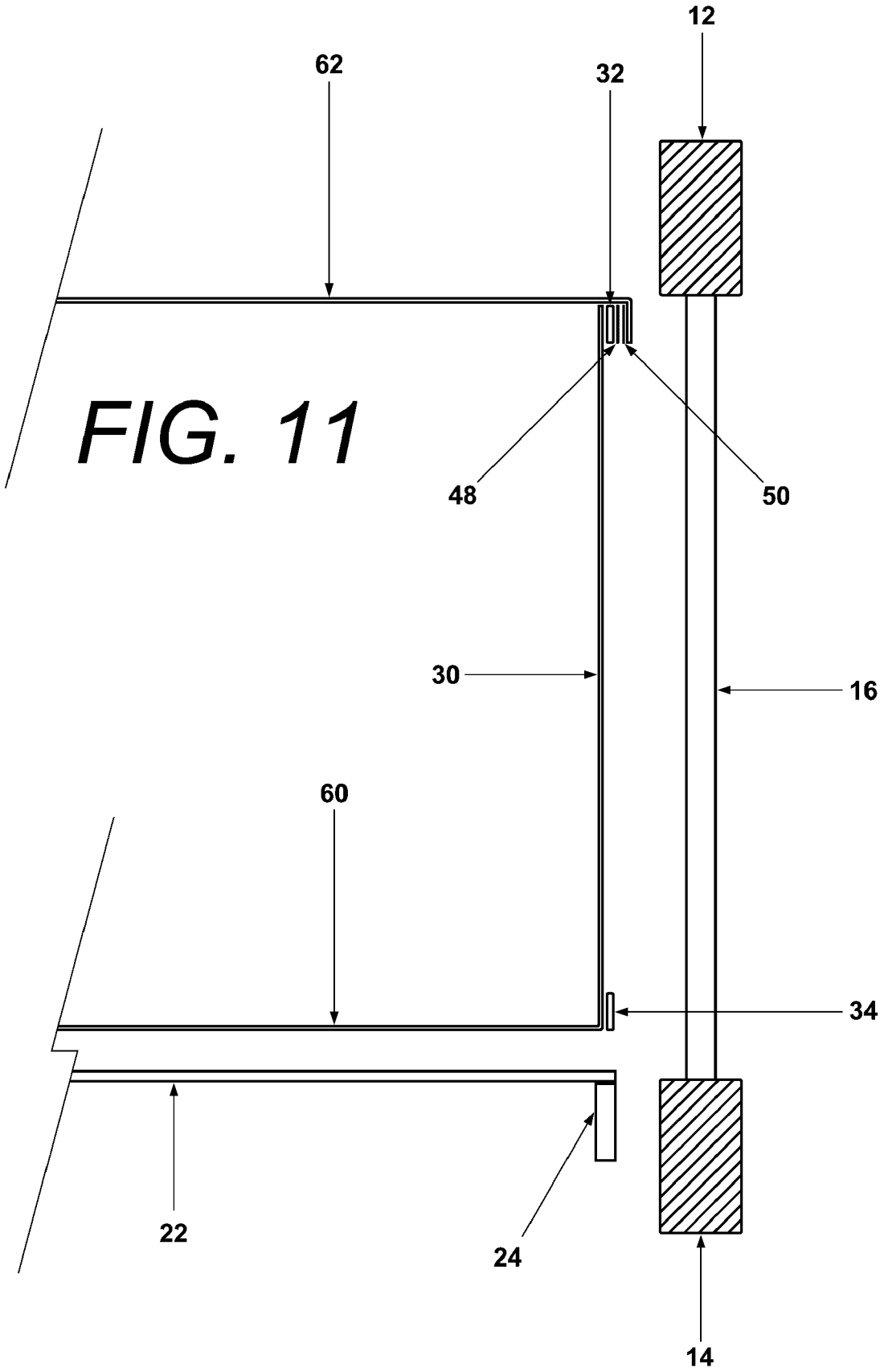
FIG. 11 shows a cross sectional view of the present invention, depicting a mesh crib bumper with an attached mesh panel base, with horizontal straps sewn onto the top and bottom edges, and a Velcro edged removable mesh fabric top panel installed inside a crib.

Referring to FIG. 11, there is shown a cross sectional view of FIG. 10. The mesh crib bumper 3 is installed inside a rectangular crib 1 with four top horizontal crib rails 12 and four bottom horizontal crib rails 14 with vertical crib balusters 16 connecting the top and bottom crib rails 12 and 14. The rectangular crib 1 has an immovable support spring or lattice attached to the crib's lower horizontal rail section 14 or on a structurally reinforced edge 24 vertically adjustable horizontal support member 22 attached to the crib's lower horizontal rail section 14. The mesh crib bumper 3 has a bottom mesh panel base 60 attached to the bottom of the four connected vertical mesh panels 30 for laying a baby onto. The mesh crib bumper 3 also has a top mesh panel lid 62 attached to the top of the four connected vertical mesh panels 30 using a preferred hook 50 and loop 48 Velcro™ fastening means.

Figure 12:
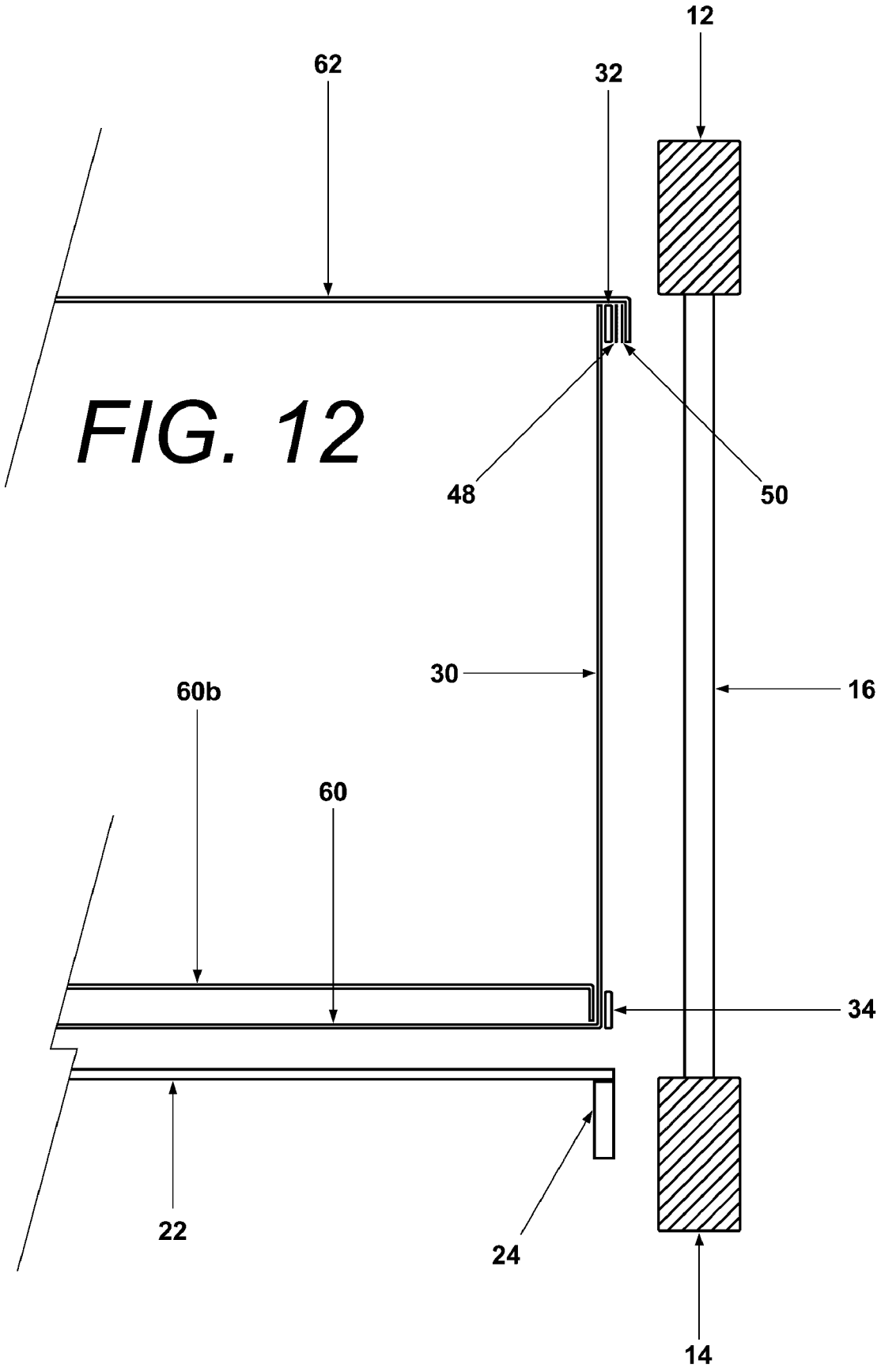
FIG. 12 shows a cross sectional view of the present invention, depicting a mesh crib bumper with two attached mesh panel bases, with horizontal straps sewn onto the top and bottom edges, and a Velcro edged removable mesh fabric top panel installed inside a crib.

Referring to FIG. 12, there is shown a cross sectional view of FIG. 10. The mesh crib bumper 3 is installed inside a rectangular crib 1 with four top horizontal crib rails 12 and four bottom horizontal crib rails 14 with vertical crib balusters 16 connecting the top and bottom crib rails 12 and 14. The rectangular crib 1 has an immovable support spring or lattice attached to the crib's lower horizontal rail section 14 or on a structurally reinforced edge 24 vertically adjustable horizontal support member 22 attached to the crib's lower horizontal rail section 14. The mesh crib bumper 3 has a bottom mesh panel base **60*b* attached to the bottom of the four connected vertical mesh panels 30 for laying a baby onto and a second bottom mesh panel base 60 to prevent an insect from biting a baby while it is laying on the bottom mesh panel base 60*b*. The mesh crib bumper 3 also has a top mesh panel lid 62 attached to the top of the four connected vertical mesh panels 30 using a preferred hook 50 and loop 48** Velcro™ fastening means.

Figure 13:
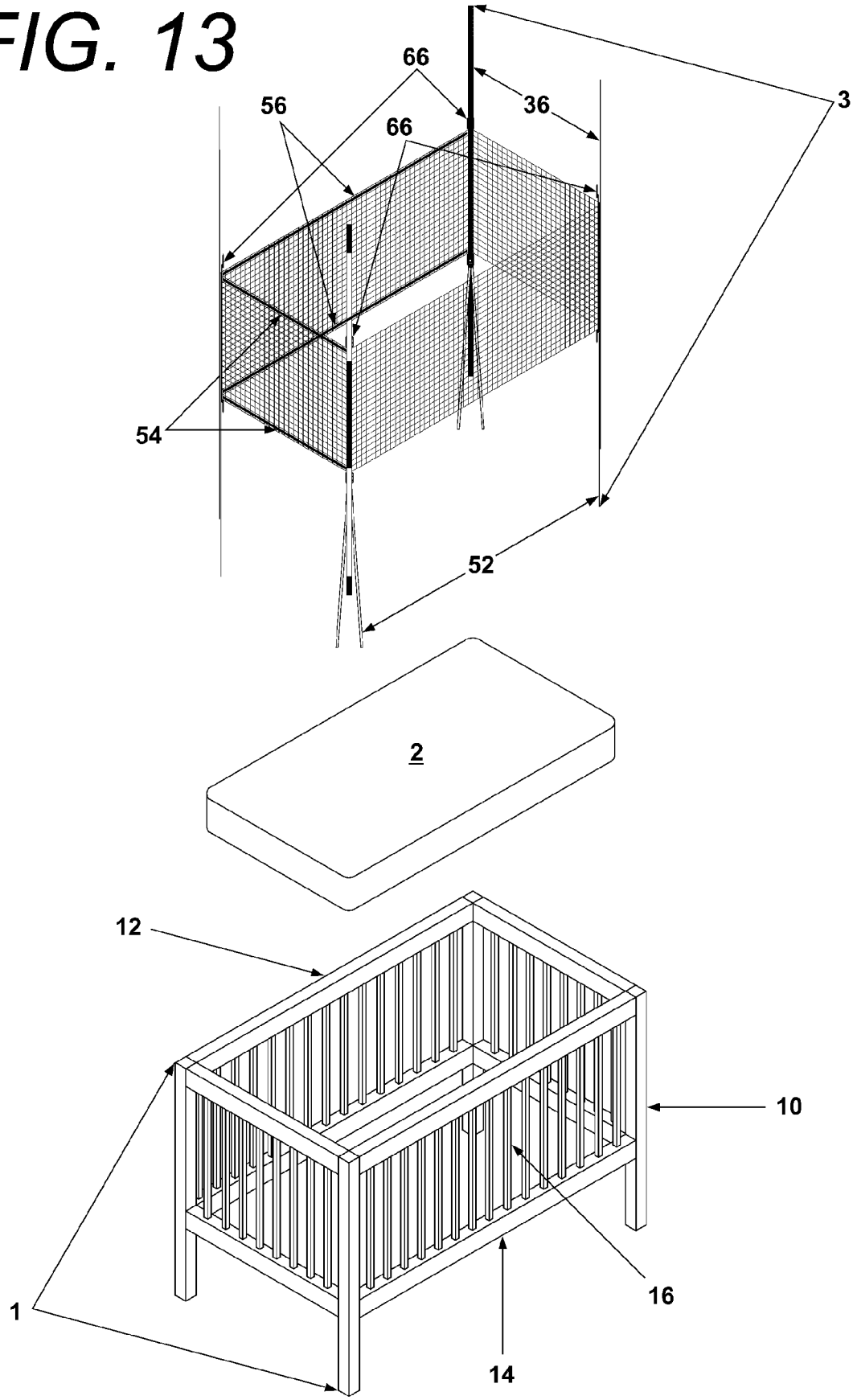
FIG. 13 shows a perspective view of the present invention, depicting a standard crib without a mattress support, a crib mattress and a mesh crib bumper showing fastening straps in all four corners, and horizontal support members inserted in the top and bottom seams for the head, foot and side mesh fabric panels, and tie string fasteners for securing the mesh crib bumper to the bottom crib rail. Vertical support members not shown.

Referring to FIG. 13, there is shown a front elevational view of FIG. 7 where the four vertical mesh panels 30 are approximately twice the height of the four vertical mesh panels 30 in FIG. 1. The means of supporting the four connected vertical mesh panels 30 within the crib 1, use four double sided adjustable vertical straps 36, one in each corner, for wrapping around and securing to an outside vertical corner post 10. Each double sided adjustable vertical straps 36 has a fastening means 40 on an inside strap, preferably a double bar buckle at the fastening end, and a length of strap for wrapping around an outside vertical corner post 10 and feeding it through and securing it through the fastening means 40. The four double sided adjustable vertical straps 36 use a fastening means 40 on the top and bottom ends of an inside strap. Four adjustable fastening means 52, preferably tie string fasteners, located on the four bottom edge corners, for securing the mesh crib bumper 3 to the bottom crib rails 14. The top and bottom edges of the two side vertical mesh panels 30 receive a horizontal support member 56 in the sewn edge receiving pocket to prevent vertical compression. The top and bottom edges of the head and foot vertical mesh panels 30 receive a horizontal support member 54 in the sewn edge receiving pocket to prevent vertical compression. When the mesh crib bumper 3 is properly installed in a crib 1, the head and foot vertical mesh panel 30 sections are so taut, the horizontal support members 54 are not needed. Horizontal support members 54 and 56 are not needed when the top and bottom edges of the vertical mesh panels 30 are reinforced with a rigid binding means. An alternative construction means to increase manufacturing speed and reduce manufacturing costs, uses an adjustable vertical strap 36 attached to the four inside corners and a fastening means 40, preferably an adjustable double bar buckle attached to the top and bottom section adjacent to the mesh crib bumper 3 corners, with the excess length of strap for wrapping around an outside vertical corner post 10 and feeding it through and securing it through the fastening means 40. Vertical support members are not shown inserted into the four corners of the vertical mesh panels 30, but are preferably required to prevent vertical compression of the four vertical mesh panels 30 and maintain uniformity of the mesh crib bumper 3 structure.

Figure 14:
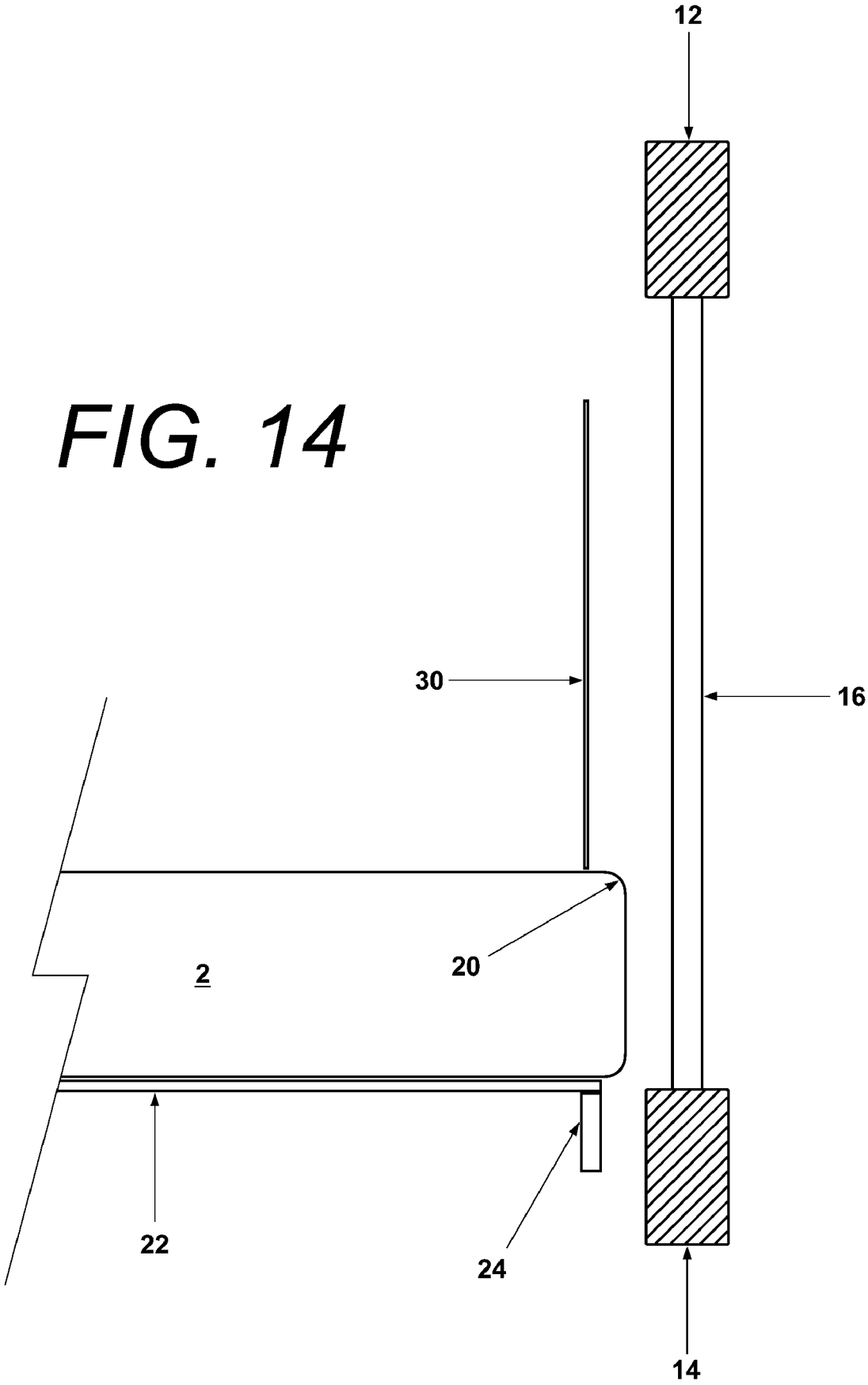
FIG. 14 shows a cross sectional view of the present invention, depicting a mesh crib bumper, installed inside a crib from four corners on top of a crib mattress.

Referring to FIG. 14, there is shown a cross sectional view of FIG. 13. The mesh crib bumper 3 is installed inside a rectangular crib 1 with four top horizontal crib rails 12 and four bottom horizontal crib rails 14 with vertical crib balusters 16 connecting the top and bottom crib rails 12 and 14. The rectangular crib 1 receives a rectangular crib mattress 2 which sits on an immovable support spring or lattice attached to the crib's lower horizontal rail section 14 or on a structurally reinforced edge 24 vertically adjustable horizontal support member 22 attached to the crib's lower horizontal rail section 14. The mesh crib bumper 3 has four vertical mesh panels 30 connected at four vertical corners and preferably a securing method attached to the bottom of four corners of the four adjustable the vertical straps 36 for securing the mesh crib bumper 3 to the bottom of the crib rails 14. The bottom edge of mesh crib bumper 3 is preferably positioned on top of the inside surface of the mattress top edge 20. The top and bottom edges of the head and foot vertical mesh panels 30 preferably receive a horizontal support member 56, not shown, in the sewn edge receiving pocket to prevent vertical compression.

Figure 15:
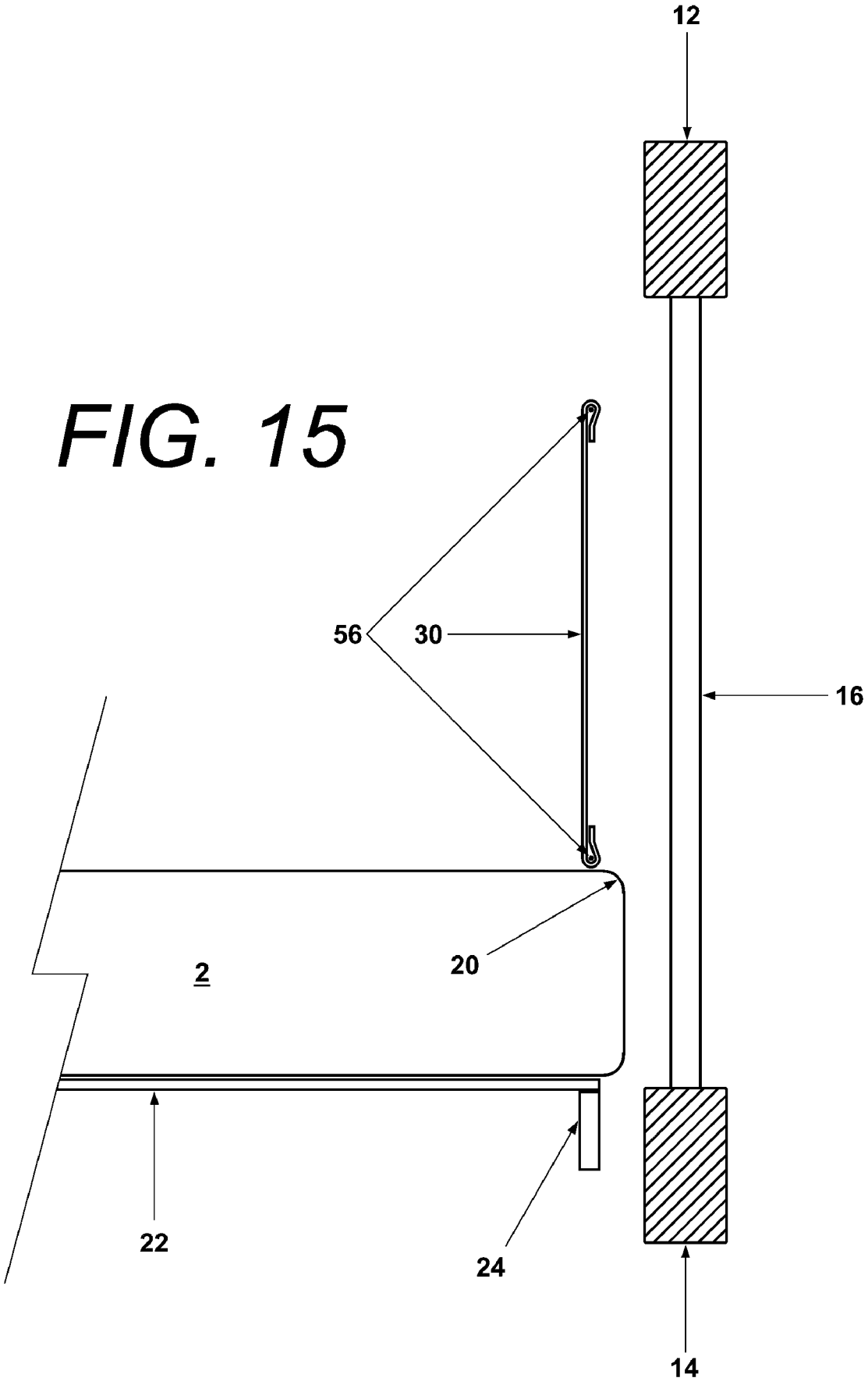
FIG. 15 shows a cross sectional view of the present invention, depicting a mesh crib bumper, with horizontal support members inserted in the top and bottom edges, installed inside a crib from four corners on top of a crib mattress.

Referring to FIG. 15, there is shown a cross sectional view of FIG. 13. The mesh crib bumper 3 is installed inside a rectangular crib 1 with four top horizontal crib rails 12 and four bottom horizontal crib rails 14 with vertical crib balusters 16 connecting the top and bottom crib rails 12 and 14. The rectangular crib 1 receives a rectangular crib mattress 2 which sits on an immovable support spring or lattice attached to the crib's lower horizontal rail section 14 or on a structurally reinforced edge 24 vertically adjustable horizontal support member 22 attached to the crib's lower horizontal rail section 14. The mesh crib bumper 3 has four vertical mesh panels 30 connected at four vertical corners and preferably a securing method attached to the bottom of four corners of the four adjustable the vertical straps 36 for securing the mesh crib bumper 3 to the bottom of the crib rails 14. The bottom edge of mesh crib bumper 3 is preferably positioned on top of the inside surface of the mattress top edge 20. The top and bottom edges of the head and foot vertical mesh panels 30 preferably receive a horizontal support member 56 in the sewn edge receiving pocket to prevent vertical compression.

Figure 16:
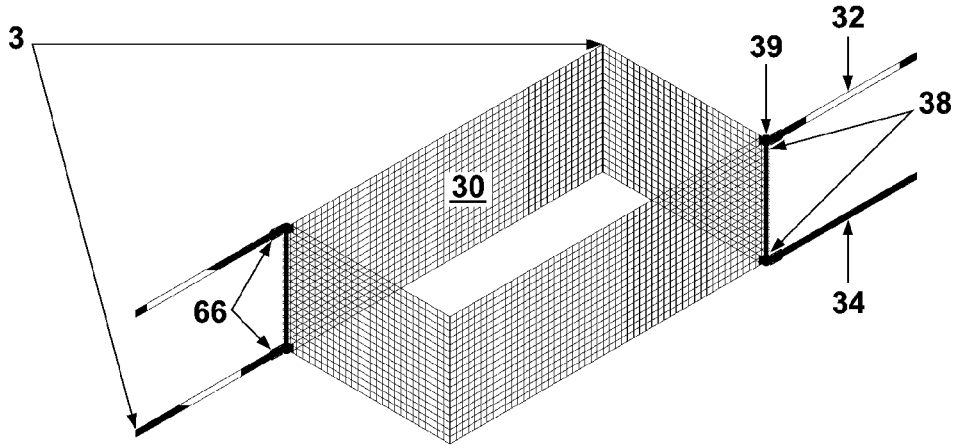
FIG. 16 shows a perspective view of the present invention, depicting a standard crib without a mattress support, a crib mattress and a mesh crib bumper with four top vertical connecting straps connected to the four top corners of the mesh crib bumper and four bottom vertical connecting straps connected to the four bottom corners of the mesh crib bumper.
Figure 16:
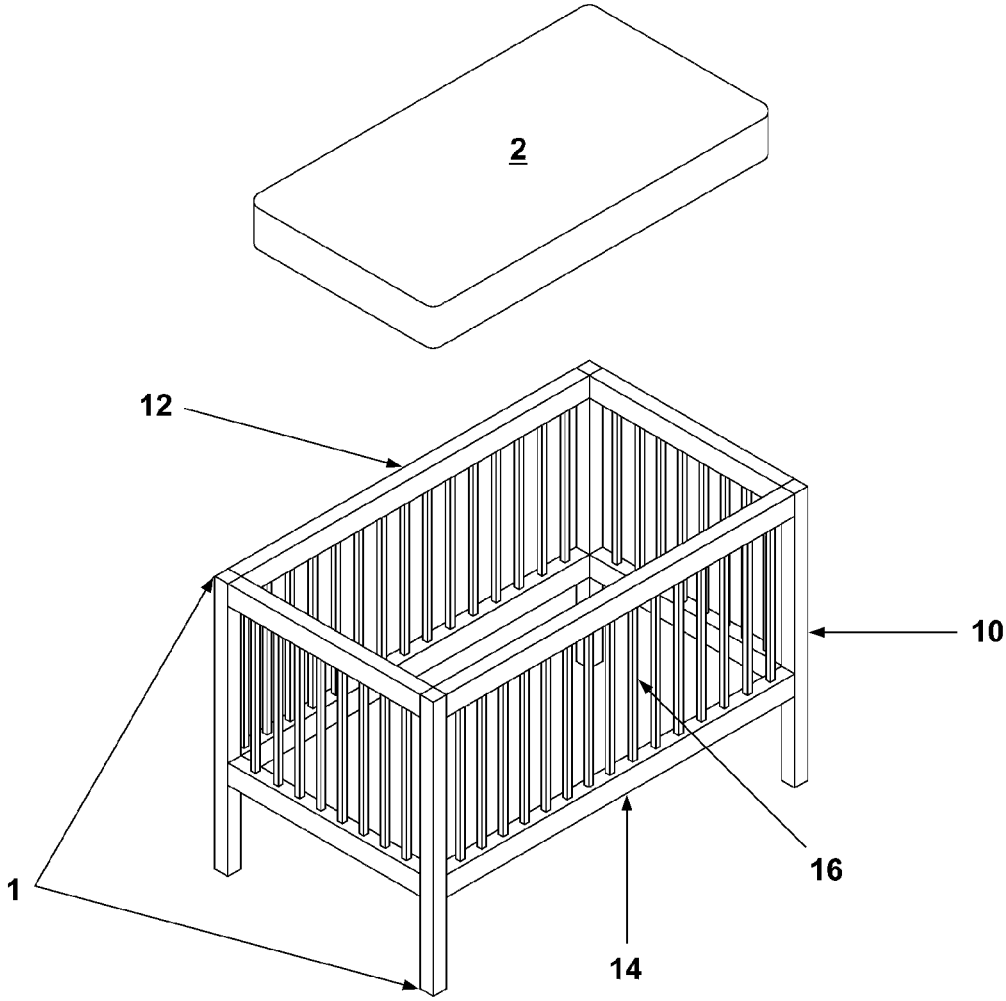

Referring to FIG. 16, there is shown a breathable mesh crib bumper 3 positioned and secured inside of the rectangular crib 1 from four vertical corner posts 10. The mesh crib bumper 3 has four vertical mesh panels 30 connected at four vertical corners. The crib securing method uses four adjustable bottom straps 34 attached to the bottom of the four vertical corners and a fastening means 66, preferably a double bar buckle, attached to the bottom straps 34 next to the bottom of the four vertical corners. The four adjustable bottom straps 34 wrap around an outside vertical corner post 10 and feed through and secure to the fastening means 66. Four adjustable top straps 32 are attached to the top of the four vertical corners and a fastening means 66, preferably a double bar buckle, attached to the top straps 32 next to the top of the four vertical corners. The four adjustable top straps 32 wrap around an outside vertical corner post 10 and feed through and secure to the fastening means 66. The four connected vertical mesh panels 30 have four vertical corner pockets 38 for receiving a vertical support member 39 to prevent the four connected vertical mesh panels 30 from being vertically compressed and to maintain horizontal tension.

Figure 17:
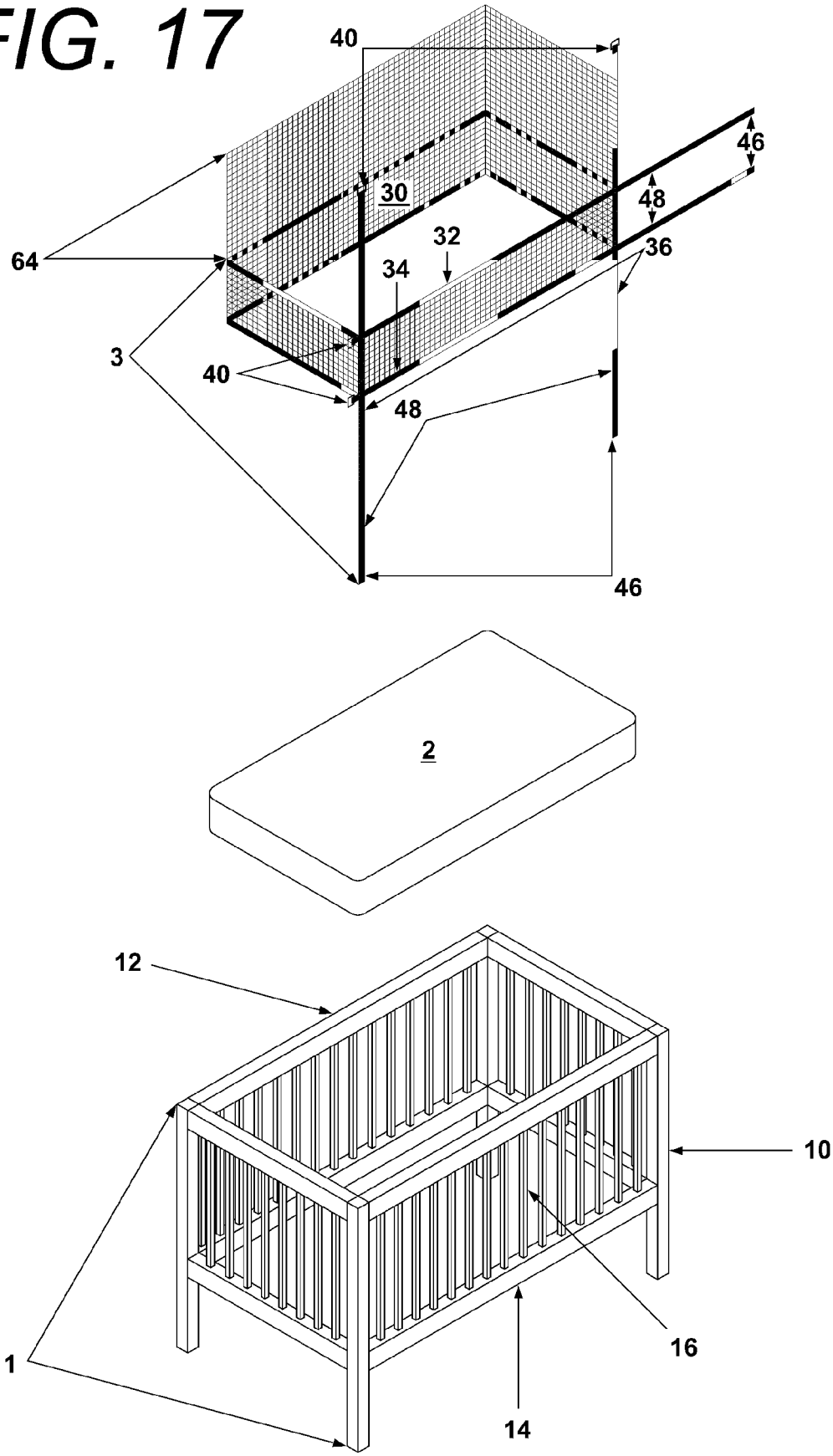
FIG. 17 shows a perspective view of the present invention, depicting a standard crib without a mattress support, a crib mattress and a mesh crib bumper with horizontal and vertical connecting straps and top panel extensions for wrapping and securing over the top of four crib rails.

Referring to FIG. 17, there is shown a front elevational view of FIG. 1 without the four adjustable fastening means 52, preferably tie string fasteners, located on the four bottom edge corners, for securing the mesh crib bumper 3 to the bottom crib rails 14. The four connected vertical mesh panels 30 have eight adjustable vertical straps 36, two on each corner, for wrapping around a top rail 12 and a bottom rail 14 of the crib 1. The eight adjustable vertical straps 36 with a fastening means 40 at one end to wrap over a top rail 12, preferably a the buckle device, and a length of strap to wrap around a bottom rail 14 and feed through and secure to the fastening means 40. The fastening means 40 in FIG. 3 shows a belt loop and a length of the eight vertical straps 36 to feed through and secure to the fastening means 40, with a hook Velcro™ fastener strip 46 sewn onto the outside end of eight adjustable vertical straps 36 and a loop Velcro™ fastener strip 48 sewn onto the outside surface of eight adjustable vertical straps 36. The top of the four vertical mesh panels 30 have mesh fabric extension panels 64 which extend over the crib's top rail 12 to prevent a child from sticking an appendage or object in between the mesh crib bumper 3 and the crib rails 12 and 16. The top edges of the mesh fabric extension panels 64 preferably have a means of securing the top edges to the outside surface of the crib rails 12 and 16.

Figure 18:
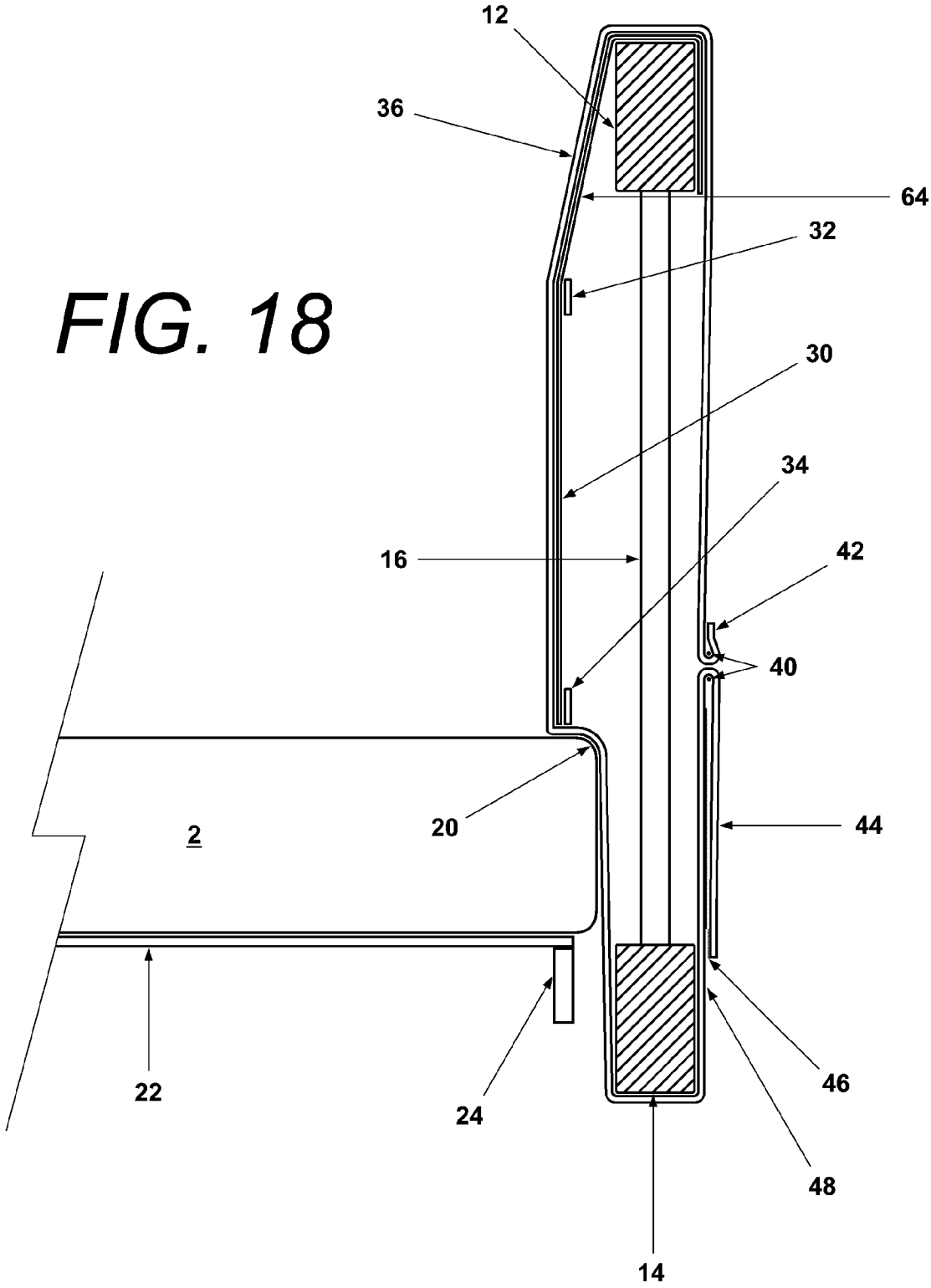
FIG. 18 shows a cross sectional view of the present invention, depicting a mesh crib bumper, with horizontal straps sewn onto the top and bottom edges and vertical support straps sewn onto the inside surface of the mesh crib bumper, installed inside a crib on top of a crib mattress with top panel extensions for wrapping and securing over the top of four crib rails.

Referring to FIG. 18, there is shown a cross sectional view of FIG. 16. The mesh crib bumper 3 is installed inside a rectangular crib 1 with four top horizontal crib rails 12 and four bottom horizontal crib rails 14 with vertical crib balusters 16 connecting the top and bottom crib rails 12 and 14. The rectangular crib 1 receives a rectangular crib mattress 2 which sits on an immovable support spring or lattice attached to the crib's lower horizontal rail section 14 or on a structurally reinforced edge 24 vertically adjustable horizontal support member 22 attached to the crib's lower horizontal rail section 14. The mesh crib bumper 3 has four vertical mesh panels 30 connected at four vertical corners and preferably a securing method attached to the four corners of the four adjustable bottom horizontal straps 34 for securing the mesh crib bumper 3 to the bottom of the crib rails 14. The bottom edge of the horizontal strap 34 is preferably positioned on top of the inside surface of the mattress top edge 20. Vertical straps 36 are attached to the inside or outside surfaces of the vertical mesh panels 30. The vertical straps 36 wrap around the top of the top rail 12 and the bottom of the bottom rail 14 and are attached on the outside of the crib 1. The end of the vertical strap 36, wrapped around the top of the top rail 12, preferably uses a strap connecting buckle 40 sewn onto the vertical strap end 42. The opposite vertical strap end 44 of the vertical strap 36, wrapped around the bottom of the bottom rail 14, is inserted through the connecting buckle 40, and preferably uses a hook 46 and loop 48 securing means. The top of the four vertical mesh panels 30 have mesh fabric extension panels 64 which extend over the crib's top rail 12 to prevent a child from sticking an appendage or object in between the mesh crib bumper 3 and the crib rails 12 and 16. The top edges of the mesh fabric extension panels 64 preferably have a means of securing the top edges to the outside surface of the crib rails 12 and 16.

These and other features of the present invention will be more fully understood by referencing the drawings.

In summary, the breathable mesh crib bumper invention, according to the preferred embodiments and alternative preferred embodiments of the invention, provides a mesh crib bumper insert which is breathable and allows air to circulate through it, an enclosure that prevents a baby from impacting their head or appendages against a crib's balusters or four corner posts, an enclosure that prevents a baby from sticking their head or appendages through a crib's balusters or reaching over the top of the crib enclosure, an enclosure that prevents objects from falling outside of the enclosure, an enclosure that is installed into and removed out of the crib fast and easily for crib maintenance and for cleaning, an enclosure including a bottom horizontal mesh surface for laying a baby onto or for positioning on top of or under a mattress and an enclosure with a sealable top mesh panel for keeping insects and animals out of the crib's enclosure.

The present invention and its many preferred embodiments, disclosed and not disclosed, all use taut connected breathable mesh fabric panels preferably secured to four vertical corner posts, allowing air to circulate through the crib compartment, while preventing an object within the enclosure from coming in contact with object located outside the enclosure or from an object getting inside the enclosure through the taut breathable mesh fabric panels.

While the invention has been described with reference to the preferred embodiments thereof, it will be appreciated by those of ordinary skill in the art that various modifications can be made to the invention without departing from the spirit and scope of the invention as a whole.

The invention claimed is:

1. A mesh crib bumper comprising:

a) four taut vertical mesh panels spaced away from a crib's four vertical barriers and connected to four peripheral vertical posts from a top edge and a bottom edge to maintain said spacing; and b) an adjustable connecting device for spacing said four vertical mesh panels away from four connected top and bottom horizontal rails connecting said four peripheral vertical posts.

2. A mesh crib bumper, in accordance with claim 1, wherein:

a horizontal mesh panel base is connected to four horizontal bottom edges of said four connected vertical mesh panels.

3. A mesh crib bumper, in accordance with claim 1, wherein:

a) a first horizontal mesh panel base is connected to four horizontal bottom edges of said four connected vertical mesh panels; and b) a second horizontal mesh panel base is connected to an inner surface of said four connected vertical mesh panels above said first horizontal mesh panel base producing a gap between said first horizontal mesh panel base and said second horizontal mesh panel base.

4. A mesh crib bumper, in accordance with claim 1, wherein:

said four connected vertical mesh panels are fastened to said four peripheral vertical posts from four top corners and four bottom corners using eight adjustable fastening means.

5. A mesh crib bumper, in accordance with claim 1, wherein:

said four connected vertical mesh panels are vertically secured in place from four bottom edge corners to four horizontal bottom crib rail corners using four adjustable fastening means.

6. A mesh crib bumper, in accordance with claim 1, wherein:

said four connected vertical mesh panel corners are prevented from being vertically compressed by inserting a rigid vertical support member into four vertical receiving corner pockets.

7. A mesh crib bumper, in accordance with claim 1, wherein:

said four connected vertical mesh panels are prevented from being vertically compressed using four rigid horizontal support members in four horizontal receiving pockets.

8. A mesh crib bumper comprising:

a) four taut vertical mesh panels spaced away from a crib's four vertical barriers and connected to each other producing four vertical corners;

b) a horizontal mesh panel base is connected to four horizontal bottom edges of said four connected vertical mesh panels;

c) a horizontal mesh panel top is connected to four horizontal top edges of said four connected vertical mesh panels using a re-sealable closure means; and d) said four vertical mesh panel corners are attached to four peripheral vertical posts from a top edge and a bottom edge to maintain said spacing.

9. A mesh crib bumper, in accordance with claim 8, wherein:

a) a first said horizontal mesh panel base is connected to four horizontal bottom edges of said four connected vertical mesh panels; and b) a second horizontal mesh panel base is connected to an inner surface of said four connected vertical mesh panels above said first horizontal mesh panel base producing a gap between said first horizontal mesh panel base and said second horizontal mesh panel base.

10. A mesh crib bumper, in accordance with claim 8, wherein:

said four connected vertical mesh panels are attached to said four peripheral vertical posts using eight adjustable fastening means.

* * * * *